US010287751B2

(12) United States Patent
Mori et al.

(10) Patent No.: US 10,287,751 B2
(45) Date of Patent: May 14, 2019

(54) HYDRAULIC DRIVE SYSTEM FOR WORKING MACHINE INCLUDING TRACK DEVICE OF CRAWLER TYPE

(71) Applicant: HITACHI CONSTRUCTION MACHINERY TIERRA CO., LTD., Shiga (JP)

(72) Inventors: Kazushige Mori, Koka (JP); Yasutaka Tsuruga, Moriyama (JP); Kiwamu Takahashi, Koka (JP); Yoshifumi Takebayashi, Koka (JP)

(73) Assignee: Hitachi Construction Machinery Tierra Co., Ltd., Shiga (JP)

( * ) Notice: Subject to any disclaimer, the term of this patent is extended or adjusted under 35 U.S.C. 154(b) by 292 days.

(21) Appl. No.: 15/262,500

(22) Filed: Sep. 12, 2016

(65) Prior Publication Data

US 2016/0376769 A1 Dec. 29, 2016

Related U.S. Application Data

(63) Continuation of application No. 13/976,232, filed as application No. PCT/JP2012/050126 on Jan. 5, 2012, now abandoned.

(30) Foreign Application Priority Data

Jan. 6, 2011 (JP) ..... 2011-001422

(51) Int. Cl.
*E02F 9/22* (2006.01)
*E02F 9/02* (2006.01)
(Continued)

(52) U.S. Cl.
CPC ..... *E02F 9/2267* (2013.01); *E02F 9/02* (2013.01); *E02F 9/2225* (2013.01);
(Continued)

(58) Field of Classification Search
CPC ..... E02F 9/02; E02F 9/2225; E02F 9/2228; E02F 9/2232; E02F 9/2235; E02F 9/2271;
(Continued)

(56) References Cited

U.S. PATENT DOCUMENTS 4,617,854 A * 10/1986 Kropp ..... E02F 9/2225 60/422
5,079,919 A * 1/1992 Nakamura ..... E02F 9/2235 60/426

(Continued)

FOREIGN PATENT DOCUMENTS

DE 44 23 572 A1 1/1996
JP 06-048197 A 2/1994

(Continued)

OTHER PUBLICATIONS

International Preliminary Report on Patentability received in International Application No. PCT/JP2012/050126 dated Jul. 18, 2013.

(Continued)

*Primary Examiner* — Thomas E Lazo
*Assistant Examiner* — Richard C Drake
(74) *Attorney, Agent, or Firm* — Mattingly & Malur, PC

(57) ABSTRACT

A hydraulic drive system for a track device of crawler type has right and left hydraulic track motors. The hydraulic drive system is capable of correcting for skew occurring in the straight line traveling of the track device. A traveling test is conducted upon shipment from a factory. If skew is noted during the test, a plug disposed on the side of a valve opening-side pressure receiving portion of a pressure compensating valve for the track which is lower in speed is removed and, replaced with an adjusting mechanism-mounted plug having an adjusting pin. The pin is operated so as to strengthen a biasing force of a target compensating differential pressure adjusting spring. An opening in the (Continued)

pressure compensating valve is thereby corrected in an opening direction and a flow rate to one of the left and right track motors is thereby adjusted to be equal to the other motor.

1 Claim, 17 Drawing Sheets

(51) Int. Cl.

| | |
|---|---|
| ***F15B 11/16*** | (2006.01) |
| ***F04B 17/03*** | (2006.01) |
| ***E02F 9/26*** | (2006.01) |
| *E02F 3/32* | (2006.01) |
| *E02F 3/96* | (2006.01) |

(52) U.S. Cl.
CPC ..... *E02F 9/2228* (2013.01); *E02F 9/2232* (2013.01); *E02F 9/2235* (2013.01); *E02F 9/2271* (2013.01); *E02F 9/2285* (2013.01); *E02F 9/2292* (2013.01); *E02F 9/2296* (2013.01); *E02F 9/267* (2013.01); *F04B 17/03* (2013.01); *F15B 11/163* (2013.01); *F15B 11/165* (2013.01); *E02F 3/325* (2013.01); *E02F 3/964* (2013.01); *F15B 2211/20523* (2013.01); *F15B 2211/20546* (2013.01); *F15B 2211/20553* (2013.01); *F15B 2211/20576* (2013.01); *F15B 2211/30535* (2013.01); *F15B 2211/3111* (2013.01); *F15B 2211/3116* (2013.01); *F15B 2211/6054* (2013.01)

(58) Field of Classification Search
CPC ..... E02F 9/2285; E02F 9/2292; E02F 9/2296; E02F 9/267; E02F 9/2267; F15B 11/162; F15B 11/165
See application file for complete search history.

(56) References Cited

U.S. PATENT DOCUMENTS

| | | | | | |
|---|---|---|---|---|---|
| 5,129,229 | A * | 7/1992 | Nakamura | E02F 9/2232 | 137/596.13 |
| 5,170,625 | A * | 12/1992 | Watanabe | E02F 9/2235 | 60/452 |
| 5,267,440 | A * | 12/1993 | Nakamura | E02F 9/2232 | 60/426 |
| 5,285,642 | A * | 2/1994 | Watanabe | E02F 9/2228 | 60/426 |
| 5,289,679 | A * | 3/1994 | Yasuda | E02F 9/2232 | 60/422 |
| 5,560,204 | A * | 10/1996 | Ishihama | B62D 11/18 | 180/6.48 |
| 5,937,645 | A * | 8/1999 | Hamamoto | F15B 13/0417 | 60/422 |
| 6,050,090 | A | 4/2000 | Tohji | | |
| 6,397,591 | B1 * | 6/2002 | Tsuruga | E02F 3/325 | 60/422 |
| 6,408,622 | B1 * | 6/2002 | Tsuruga | E02F 9/2207 | 60/422 |
| 6,557,277 | B1 | 5/2003 | Hibi | | |
| 6,644,025 | B1 | 11/2003 | Oberhausser | | |
| 7,395,664 | B2 * | 7/2008 | Brockmann | F15B 11/162 | 60/422 |
| 7,900,445 | B2 * | 3/2011 | Brockmann | F15B 11/162 | 60/422 |
| 8,622,365 | B2 * | 1/2014 | Fukano | F16K 7/045 | 251/7 |
| 9,976,283 | B2 * | 5/2018 | Tsuruga | F15B 11/17 | |
| 2002/0029566 | A1 | 3/2002 | Sawada | | |
| 2002/0134227 | A1 * | 9/2002 | Nakatani | E02F 9/22 | 91/446 |
| 2011/0168933 | A1 * | 7/2011 | Shimizu | H01F 7/127 | 251/129.15 |
| 2011/0173964 | A1 * | 7/2011 | Takahashi | E02F 9/2225 | 60/451 |
| 2013/0227936 | A1 * | 9/2013 | Takahashi | E02F 9/2235 | 60/297 |
| 2014/0227104 | A1 * | 8/2014 | Takahashi | E02F 9/2095 | 417/42 |
| 2015/0323092 | A1 * | 11/2015 | Yakushijin | F16K 31/1221 | 137/484.2 |
| 2015/0330415 | A1 * | 11/2015 | Takahashi | F15B 11/165 | 60/420 |
| 2016/0319635 | A1 * | 11/2016 | Du | E21B 43/12 | |

FOREIGN PATENT DOCUMENTS

| | | | |
|---|---|---|---|
| JP | 06-330901 | A | 11/1994 |
| JP | 07-076863 | A | 3/1995 |
| JP | 2001-193705 | A | 7/2001 |
| JP | 2003-004003 | A | 1/2003 |
| JP | 2003-113806 | A | 4/2003 |
| JP | 2006-082767 | A | 3/2006 |

OTHER PUBLICATIONS

Extended European Search Report received in corresponding European Application No. 12732178.4 dated Dec. 8, 2017.

* cited by examiner

HYDRAULIC DRIVE SYSTEM FOR WORKING MACHINE INCLUDING TRACK DEVICE OF CRAWLER TYPE

CROSS-REFERENCE TO RELATED APPLICATION

This application is a continuation application of U.S. application Ser. No. 13/976,232, filed Jun. 26, 2013, the entirety of the contents and subject matter of all of the above is incorporated herein by reference.

TECHNICAL FIELD

The present invention relates, in general, to hydraulic drive systems for working machines including track devices of crawler type and, in particular, to a hydraulic drive system for a working machine that easily achieves straight line traveling stability during traveling.

BACKGROUND ART

A known hydraulic drive system for an actuator in a working machine including a track device of crawler type, for example, a hydraulic excavator controls a delivery flow rate of a hydraulic pump (main pump) such that a delivery pressure of the hydraulic pump is higher by a target differential pressure than a maximum load pressure of a plurality of actuators. Such a hydraulic system is called a load sensing system. The load sensing system uses a pressure compensating valve that maintains a differential pressure across each of a plurality of flow control valves at a predetermined value. The load sensing system thereby ensures that hydraulic fluid can be supplied at a ratio corresponding to an opening area of each flow control valve during a combined operation that simultaneously drives multiple actuators, regardless of the magnitude of the load pressure of each actuator.

Patent document 1, for example, discloses one type of such a load sensing system. The load sensing system disclosed in patent document 1 includes a differential pressure reducing valve that outputs a differential pressure (hereinafter referred to as a differential pressure PLS) between a delivery pressure of a hydraulic pump and a maximum load pressure of a plurality of actuators as an absolute pressure. The output pressure of the differential pressure reducing valve is then introduced to a plurality of pressure compensating valves. A target compensating differential pressure for each of the pressure compensating valves is then set using the differential pressure PLS and control is performed such that the differential pressure across the flow control valve is maintained at the differential pressure PLS. This permits the following. Specifically, if a saturation condition develops in which the hydraulic pump delivers a short supply of the delivery flow rate during the combined operation that simultaneously drives multiple actuators as described earlier, the differential pressure PLS decreases according to the degree of saturation, so that the target compensating differential pressure of the pressure compensating valve, specifically, the differential pressure across the flow control valve becomes small. The delivery flow rate of the hydraulic pump can thereby be redistributed according to the ratio of flow rate required by each actuator.

In the hydraulic drive systems for working machines including track devices of crawler type, a hydraulic system called an open circuit system that includes an open center type directional control valve (flow control valve) is widely used. Such an open circuit system is typically arranged such that hydraulic fluid is supplied independently from two hydraulic pumps to right and left track motors to thereby enable traveling, as disclosed in patent document 2. In the hydraulic drive system disclosed in patent document 2, two hydraulic fluid supply lines that supply hydraulic fluid to two directional control valves for tracks from two hydraulic pumps are connected via a skew correction circuit. When right and left track control levers are operated all the way in a direction for either a forward or reverse travel, a valve device included in the skew correction circuit is placed from a closed position in a throttled open position and, at other timing, the valve device is retained in the closed position. This prevents operability at timings other than straight line traveling operation from being aggravated and allows skew traveling to be corrected for straight line traveling during the straight line traveling operation.

PRIOR ART LITERATURE

Patent Documents

Patent Document 1: JP,A 2001-193705
Patent Document 2: JP,A 2006-82767

SUMMARY OF THE INVENTION

Problem to be Solved by the Invention

In the hydraulic drive system in the working machine including the crawler type track device, for example, a hydraulic mini-excavator, whether it be a load sensing system as disclosed in patent document 1 or an open circuit system as disclosed in patent document 2, a rated track speed determined by an engine speed and a pump delivery flow rate is determined by the opening area of the flow control valve and the capacity of the track motor. The right and left flow control valves and the right and left track motors are set to have identical specifications. In this case, a difference in actual speed between the right and left track motors (difference in revolutions per minute) is affected by the opening area of the flow control valve and displacement efficiency of the track motor. In actual applications, machining errors in products or manufacturing errors involved in the opening area of the flow control valve or in the track motor are taken into consideration. In rare cases, however, the machining errors in products or the manufacturing errors involved in the opening area of the flow control valve or in the track motor may result in a difference in speed between the right and left track motors during straight line traveling operation. When a difference in speed between the right and left track motors occurs, the vehicle body skews and is unable to travel in a straight-ahead direction as intended.

To address such problems, measures are currently taken in which the products are subjected to inspection upon, for example, shipment from factories and, should such a fault be found, a faulty track motor or other part is replaced with a good one. Meanwhile, after shipment, the same also applies to a fault that occurs during operation performed by users. The track motor is, however, large in size and requires an excessive amount of cost and work for its replacement. Additionally, the level of certainty is low.

The hydraulic drive system disclosed in patent document 2 includes two hydraulic fluid supply lines that are connected with the skew correction circuit. This circuit configuration allows skew traveling to be corrected for straight line traveling even with manufacturing errors involved in the opening area of the flow control valve or in the track motor. However, to connect the two hydraulic fluid supply lines to which hydraulic fluid is supplied from each of the two hydraulic pumps with the skew correction circuit is to reconfigure a main circuit of the hydraulic drive system. Such a circuit reconfiguration cannot be directly applied to an adjustment that assumes use of the existing main circuit as is.

An object of the present invention is to provide a hydraulic drive system for a working machine that includes a track device of crawler type and that travels with hydraulic fluid supplied from at least one hydraulic pump to right and left track motors, the hydraulic drive system being capable of easily correcting skew traveling for straight line traveling without having to replace a track motor or other large-size device and without having to specially modify a main circuit.

Means for Solving the Problem

To solve the foregoing problem, an aspect of the present invention provides a hydraulic drive system for a working machine including a track device of crawler type. The hydraulic drive system includes an engine; a variable displacement type main pump driven by the engine; a plurality of actuators including first and second track hydraulic motors driven by a hydraulic fluid delivered from the main pump; a plurality of flow control valves including first and second track flow control valves for controlling a flow rate of the hydraulic fluid supplied from the main pump to the actuators; and left and right crawlers driven through rotation of the first and second track hydraulic motors, respectively. The hydraulic drive system includes a flow rate correction device for limiting a maximum flow rate output from at least either one of the first and second track flow control valves to a predetermined flow rate.

The following two methods are available for correcting skew traveling using the flow rate correction device according to the aspect of the present invention having an arrangement as described above. In one method, the flow rate correction device is mounted for making adjustments when a skew traveling fault is found during, for example, a pre-shipment inspection of the working machine. In the other, the flow rate correction device is mounted on the hydraulic drive system of the working machine in advance and the adjustments are made as soon as a skew traveling fault is thereafter found. In the former case, which one of the track hydraulic motors associated with the first or second track flow control valve is faster (or slower) in speed is known and the flow rate correction device needs to be mounted only on one side of the first and second track flow control valves. In the latter case, however, whether the skew traveling fault exists is unknown when the flow rate correction device is mounted, which requires that the flow rate correction devices be mounted on both the first and second track flow control valves.

In either case, the flow rate correction device is mounted and an adjustment is made so that the maximum flow rate supplied to the first hydraulic motor equals the maximum flow rate supplied to the second hydraulic motor, which allows the skew traveling to be corrected for straight line traveling. This allows the skew traveling to be easily corrected for straight line traveling without having to replace a track motor or other large-size device, and having to modify specially a main circuit.

In addition, the method of mounting the flow rate correction device when the skew traveling fault is found requires only one flow rate correction device, which is economical.

The method of mounting the flow rate correction device in advance and making adjustments when the skew traveling fault is found eliminates the need for mounting the flow rate correction device when the adjustments are to be made. This enables prompt correction of skew traveling for straight line traveling. Additionally, the flow rate correction devices are mounted on both of the first and second track flow control valves. This broadens a range of correction of skew traveling for straight line traveling.

Preferably, the hydraulic drive system for a working machine including a track device of crawler type further includes: a plurality of pressure compensating valves including first and second track pressure compensating valves, each controlling a differential pressure across each of the flow control valves; and a pump control unit for performing load sensing control of a displacement volume of the main pump such that a delivery pressure of the main pump is higher by a target differential pressure than a maximum load pressure of the actuators, the pressure compensating valves controlling the differential pressure across each of the flow control valves such that the differential pressure across each of the flow control valves is held at a differential pressure between the delivery pressure of the main pump and the maximum load pressure of the actuators. In this hydraulic drive system, the flow rate correction device includes a target compensating differential pressure adjusting device for correcting a target compensating differential pressure of the track pressure compensating valve associated with the track flow control valve of the first and second track pressure compensating valves.

Through the foregoing arrangement, in a what-is-called load sensing system, an opening in the track pressure compensating valve is corrected in an opening direction or a closing direction to thereby make the maximum flow rate supplied to the first hydraulic motor equal to the maximum flow rate supplied to the second hydraulic motor. This corrects skew traveling for straight line traveling. This allows the skew traveling to be easily corrected for straight line traveling without having to replace a track motor or other large-size device, and having to modify specially a main circuit.

Preferably, in the hydraulic drive system for a working machine, the target compensating differential pressure adjusting device includes an adjusting mechanism-mounted plug including an adjusting pin for adjusting a biasing force of a spring that sets the target compensating differential pressure of the track pressure compensating valve.

Additionally, preferably, in the hydraulic drive system for a working machine, the target compensating differential pressure adjusting device includes a pressure reducing valve unit including a pressure reducing valve for correcting the target compensating differential pressure of the track pressure compensating valve by reducing a pressure of a pilot hydraulic fluid source.

Additionally, preferably, the hydraulic drive system for a working machine further includes a track operating device including a remote control valve that generates a control pilot pressure for operating the track flow rate control valve. The flow rate correction device includes a pressure control valve unit including a pressure control valve disposed between the remote control valve of the track operating device and the track flow rate control valve, the pressure control valve for reducing the control pilot pressure of the remote control valve.

Additionally, preferably, the hydraulic drive system for a working machine further includes a track operating device including a remote control valve that generates a control pilot pressure for operating the track flow rate control valve. The flow rate correction device includes a pressure reducing valve unit including a pressure reducing valve disposed between the remote control valve of the track operating device and the track flow rate control valve, the pressure reducing valve for reducing the control pilot pressure of the remote control valve.

Effect of the Invention

In the aspect of the present invention, the skew traveling can be easily corrected for straight line traveling without having to replace a track motor or other large-size device, and having to modify specially a main circuit.

MODES FOR CARRYING OUT THE INVENTION

<Hydraulic Excavator>

Figure 3:
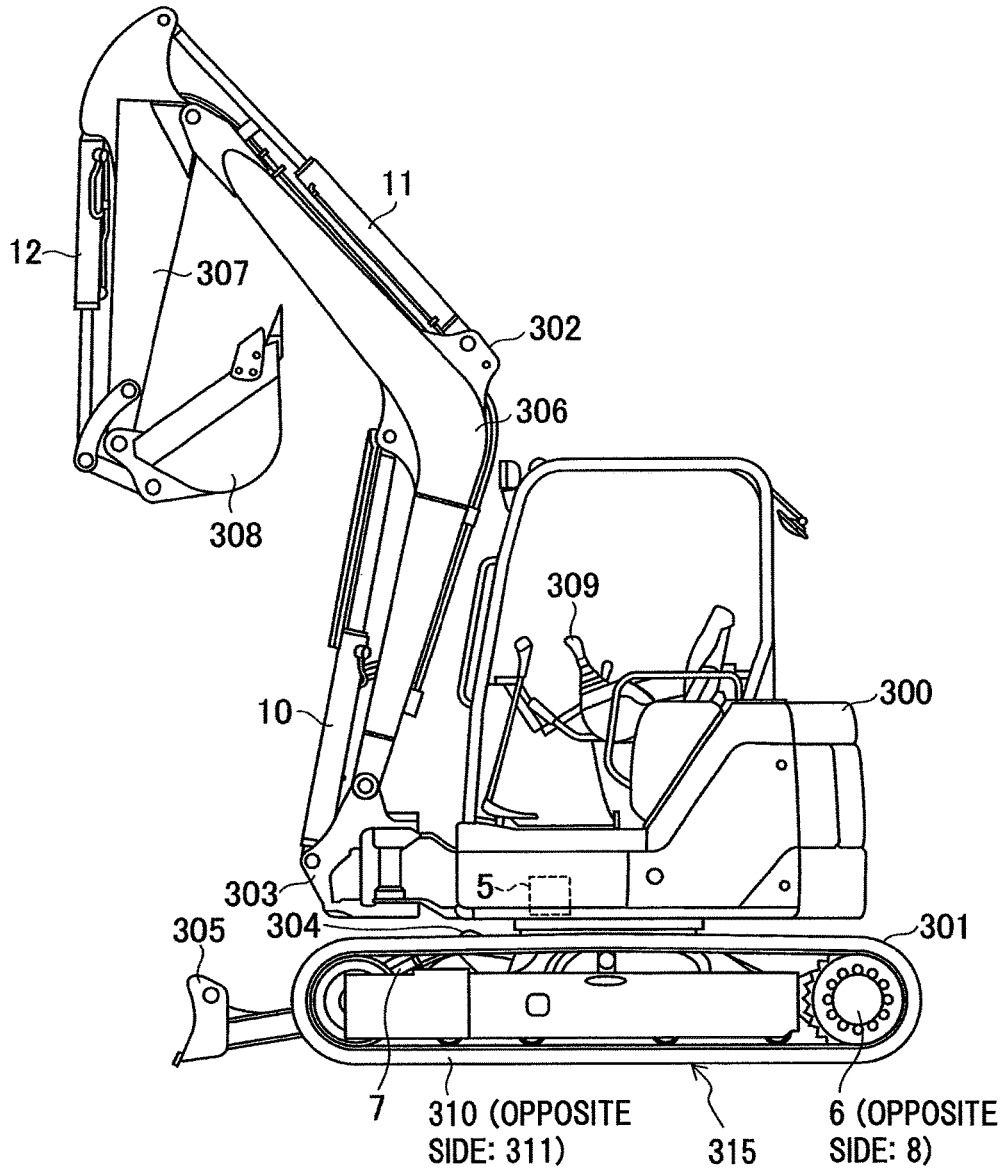
FIG. 3 is an external view showing a hydraulic excavator.

FIG. 3 shows an exterior of a hydraulic excavator.

Referring to FIG. 3, the hydraulic excavator well known as a working machine includes an upper swing structure 300, a lower track structure 301, and a swing type front work device 302. The front work device 302 includes a boom 306, an arm 307, and a bucket 308. The upper swing structure 300 is capable of turning on the lower track structure 301 through rotation of a swing motor 5. The upper swing structure 300 has a swing post 303 disposed at its front portion. The front work device 302 is mounted on the swing post 303 movably in a vertical direction. The swing post 303 is rotatable in a horizontal direction relative to the upper swing structure 300 through expansion and contraction of a swing cylinder (not shown). The boom 306, the arm 307, and the bucket 308 of the front work device 302 are rotatable in the vertical direction through expansion and contraction of a boom cylinder 10, an arm cylinder 11, and a bucket cylinder 12. The lower track structure 301 includes a center frame 304. The center frame 304 is mounted with a blade 305 that is moved up and down through expansion and contraction of a blade cylinder 7. The lower track structure 301 includes a track device of crawler type 315 that drives left and right crawlers 310, 311 through rotation of track motors 6, 8, thereby effecting traveling.

First Embodiment

Figure 1A:
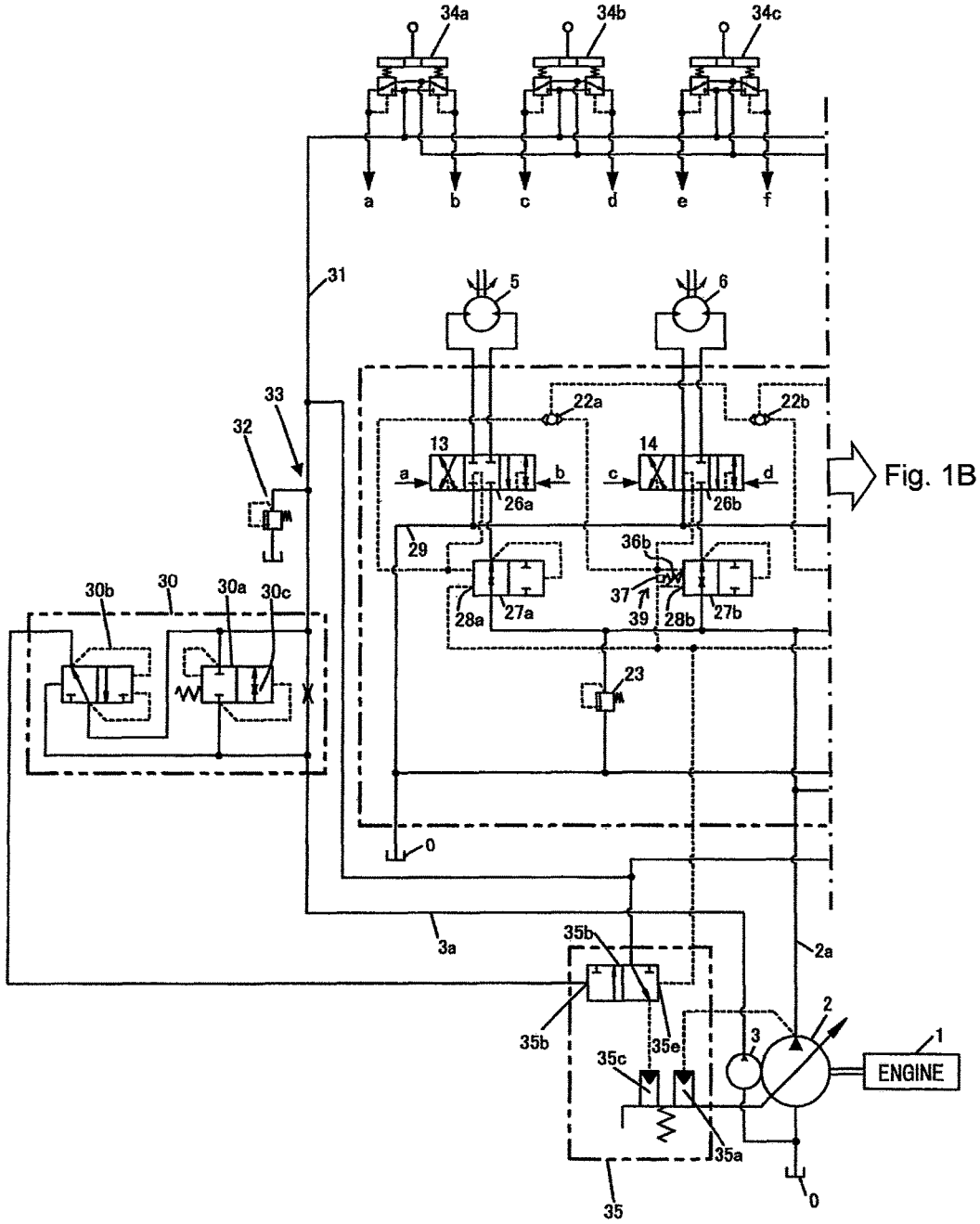
FIG. 1A is a diagram showing a left-hand half of a hydraulic drive system according to a first embodiment of the present invention.
Figures 1A, 1B:
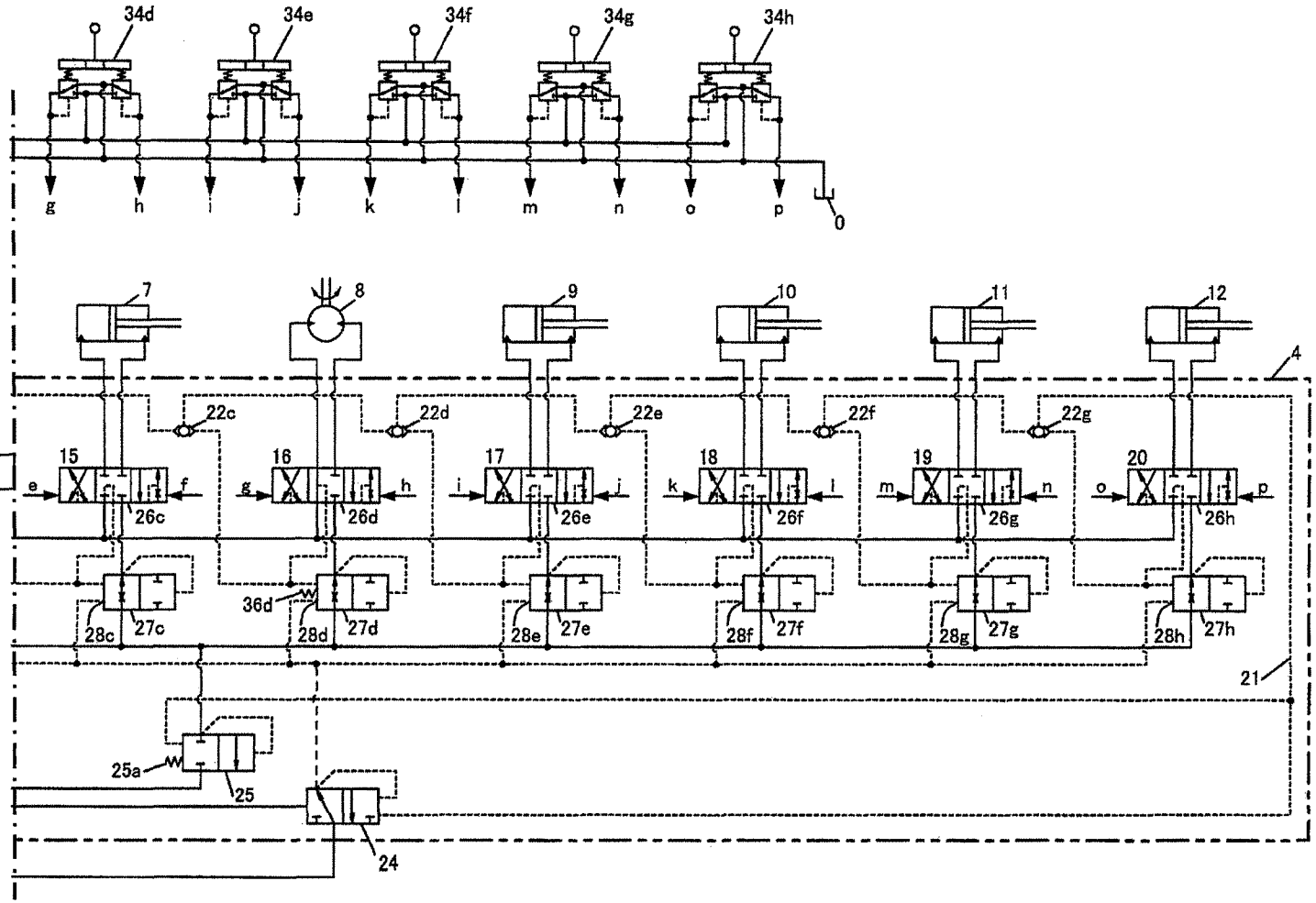
FIG. 1B is a diagram showing a right-hand half of the hydraulic drive system according to the first embodiment of the present invention.

FIGS. 1A and 1B show a hydraulic drive system for a working machine according to a first embodiment of the present invention.

The hydraulic drive system of this embodiment includes an engine 1, a main pump 2, a pilot pump 3, a plurality of actuators 5, 6, 7, 8, 9, 10, 11, 12, and a control valve 4. Specifically, the main pump 2 is driven by the engine 1. The pilot pump 3 is operatively associated with the main pump 2 and driven by the engine 1. The actuators 5, 6, 7, 8, 9, 10, 11, 12 are driven by hydraulic fluid delivered from the main pump 2.

The working machine including the track device of crawler type according to this embodiment is, for example, a hydraulic mini-excavator. The actuator 5 is, for example, the swing motor of the hydraulic excavator, the actuators 6, 8 are the left and right track motors of the hydraulic excavator, the actuator 7 is the blade cylinder of the hydraulic excavator, the actuator 9 is the swing cylinder of the hydraulic excavator, and the actuators 10, 11, 12 are the boom cylinder, the arm cylinder, and the bucket cylinder, respectively, of the hydraulic excavator.

The control valve 4 includes a plurality of valve sections 13, 14, 15, 16, 17, 18, 19, 20, a plurality of shuttle valves 22*a*, 22*b*, 22*c*, 22*d*, 22*e*, 22*f*, 22*g*, a main relief valve 23, a differential pressure reducing valve 24, and an unloading valve 25. Specifically, the valve sections 13, 14, 15, 16, 17, 18, 19, 20 are connected to a supply line 2*a* of the main pump 2 and control directions and flow rates of hydraulic fluid supplied from the main pump 2 to respective actuators. The shuttle valves 22*a*, 22*b*, 22*c*, 22*d*, 22*e*, 22*f*, 22*g* select the highest load pressure (hereinafter referred to as a maximum load pressure) PLmax of load pressures of the actuators 5, 6, 7, 8, 9, 10, 11, 12 and output the maximum load pressure Plmax to a signal line 21. The main relief valve 23 is disposed in the supply line 2*a* of the main pump 2*a* and limits a maximum delivery pressure (maximum pump pressure) of the main pump 2. The differential pressure reducing valve 24 outputs a differential pressure PLS between a delivery pressure (pump pressure) Pd of the main pump 2 and the maximum load pressure PLmax of the main pump 2 as an absolute pressure. The unloading valve 25 returns part of the hydraulic fluid delivered by the main pump 2 to a tank 0 when the differential pressure PLS between the pump pressure Pd and the maximum load pressure PLmax exceeds a predetermined value set by a spring 25*a*, thereby maintaining the differential pressure PLS at the predetermined value set by the spring 25*a* or lower. The unloading valve 25 and the main relief valve 23 have outlet sides connected to a tank line 29 within the control valve 2 and to the tank 0.

The valve section 13 includes a flow control valve 26*a* and a pressure compensating valve 27*a*. The valve section 14 includes a flow control valve 26*b* and a pressure compensating valve 27*b*. The valve section 15 includes a flow control valve 26*c* and a pressure compensating valve 27*c*. The valve section 16 includes a flow control valve 26*d* and a pressure compensating valve 27*d*. The valve section 17 includes a flow control valve 26*e* and a pressure compensating valve 27*e*. The valve section 18 includes a flow control valve 26*f* and a pressure compensating valve 27*f*. The valve section 19 includes a flow control valve 26*g* and a pressure compensating valve 27*g*. The valve section 20 includes a flow control valve 26*h* and a pressure compensating valve 27*h*.

The flow control valves 26*a* to 26*h* control directions and flow rates of hydraulic fluid supplied from the main pump 2 to the respective actuators 5 to 12. The pressure compensating valves 27*a* to 27*h* control differential pressures across the respective flow control valves 26*a* to 26*h*.

The pressure compensating valves 27*a* to 27*h* have valve opening-side pressure receiving portions 28*a*, 28*b*, 28*c*, 28*d*, 28*e*, 28*f*, 28*g*, 28*h* for setting target differential pressures. An output pressure of the differential pressure reducing valve 24 is introduced to each of the pressure receiving portions 28*a* to 28*h* and a target compensating differential pressure is set using the absolute pressure of the differential pressure PLS between the hydraulic pump pressure Pd and the maximum load pressure PLmax (hereinafter referred to as an absolute pressure PLS). By controlling to bring the differential pressures across the flow control valves 26*a* to 26*h* to the same differential pressure PLS value, the pressure compensating valves 27*a* to 27*h* control such that the differential pressures across the flow control valves 26*a* to 26*h* equal the differential pressure PLS between the hydraulic pump pressure Pd and the maximum load pressure PLmax. This allows, during a combined operation that simultaneously drives multiple actuators, the delivery flow rate of the main pump 2 to be distributed according to the opening area ratio of the flow control valves 26*a* to 26*h* regardless of the magnitude of the load pressure of each of the actuators 5 to 12, thus achieving good combined operation performance. If a saturation condition develops in which the main pump 2 delivers a short supply of delivery flow rate that falls short of a required flow rate, the differential pressure PLS decreases according to the degree of the short supply. Then, the differential pressures across the flow control valves 26*a* to 26*h* controlled by the pressure compensating valves 27*a* to 27*h* are accordingly reduced at the same rate, so that flow rates through the flow control valves 26*a* to 26*h* decreases at the same rate. In this case, too, the delivery flow rate of the main pump 2 is distributed according to the opening area ratio of the flow control valves 26*a* to 26*h*, so that good combined operation performance can be achieved.

The hydraulic drive system further includes an engine speed detecting valve device 30, a pilot hydraulic fluid source 33, and control lever devices (control devices) 34*a*, 34*b*, 34*c*, 34*d*, 34*e*, 34*f*, 34*g*, 34*h*. Specifically, the engine speed detecting valve device 30 is connected to a supply line 3*a* of the pilot pump 3 and outputs an absolute pressure according to the delivery flow rate of the pilot pump 3. The pilot hydraulic fluid source 33 is connected downstream of the engine speed detecting valve device 30 and includes a pilot relief valve 32 that maintains a constant pressure of a pilot line 31. The control lever devices 34*a*, 34*b*, 34*c*, 34*d*, 34*e*, 34*f*, 34*g*, 34*h* are connected to the pilot line 31. The control lever devices 34*a*, 34*b*, 34*c*, 34*d*, 34*e*, 34*f*, 34*g*, 34*h* include remote control valves that generate control pilot pressures a, b, c, d, e, f, g, h, i, j, k, l, m, o, p for operating the flow control valves 26*a* to 26*h* using the hydraulic pressure of the pilot hydraulic fluid source 33 as a source pressure.

The engine speed detecting valve device 30 includes a hydraulic line 30*e*, a throttle element (fixed throttle) 30*f*, a flow rate detecting valve 30*a*, and a differential pressure reducing valve 30*b*. Specifically, the hydraulic line 30*e* connects the supply line 3*a* of the pilot pump 3 to the pilot line 31. The throttle element 30*f* is disposed in the hydraulic line 30*e*. The flow rate detecting valve 30*a* is connected in parallel with the hydraulic line 30*e* and the throttle element 30*f*. The flow rate detecting valve 30*a* has an inlet side connected to the supply line 3*a* of the pilot pump 3 and an outlet side connected to the pilot line 31. The flow rate detecting valve 30*a* includes a variable throttle portion 30*c* that increases the opening area with an increasing flow rate therethrough. The hydraulic fluid delivered from the pilot pump 3 flows through both the throttle element 30*f* and the variable throttle portion 30*c* of the flow rate detecting valve 30*a* to the side of the pilot line 31. At this time, a differential pressure that increases with an increasing passing flow rate is produced across the throttle element 30*f* and the variable throttle portion 30*c* of the flow rate detecting valve 30*a*. The differential pressure reducing valve 30*b* outputs the differential pressure across the throttle element 30*f* and the variable throttle portion 30*c* as an absolute pressure Pa. The delivery flow rate of the pilot pump 3 varies according to the speed of the engine 1. Thus, detecting the differential pressure across the throttle element 30*f* and the variable throttle portion 30*c* allows the delivery flow rate of the pilot pump 3 to be detected, so that the speed of the engine 1 can be detected. In addition, the variable throttle portion 30*c* increases the opening area with an increasing flow rate therethrough (with an increasing differential pressure thereacross). The variable throttle portion 30*c* is therefore configured such that the more the passing flow rate, the milder the rate of increase in the differential pressure thereacross.

The main pump 2 is a variable displacement hydraulic pump and includes a pump control unit 35 for controlling its tilting angle (capacity). The pump control unit 35 includes a horsepower control tilting actuator 35*a*, an LS control valve 35*b*, and an LS control tilting actuator 35*c*.

The horsepower control tilting actuator 35*a* decreases the tilting angle of the main pump 2 when the delivery pressure of the main pump 2 increases, thereby ensuring that the input torque of the main pump 2 does not exceed a predetermined maximum torque. Horsepower consumption of the main pump 2 is thereby limited and the engine 1 is prevented from being stalled (engine stall) by overload.

The LS control valve 35*b* has pressure receiving portions 35*d*, 35*e* that face each other. The absolute pressure Pa (a first specified value) generated by the differential pressure reducing valve 30*b* of the engine speed detecting valve device 30 is introduced via a hydraulic line 40 to the pressure receiving portion 35*d* as a target differential pressure (target LS differential pressure) for load sensing control. The absolute pressure PLS generated by the differential pressure reducing valve 24 is introduced to the pressure receiving portion 35*e*. When the absolute pressure PLS is higher than the absolute pressure Pa (PLS>Pa), the pressure of the pilot hydraulic fluid source 33 is introduced to the LS control tilting actuator 35*c* to thereby reduce the tilting angle of the main pump 2. When the absolute pressure PLS is lower than the absolute pressure Pa (PLS<Pa), the LS control tilting actuator 35*c* is brought into communication with a tank T to thereby increase the tilting angle of the main pump 2. A tilting amount (a displacement volume) of the main pump 2 is controlled such that the delivery pressure Pd of the main pump 2 is thereby higher by the absolute pressure Pa (target differential pressure) than the maximum load pressure PLmax. The LS control valve 35*b* and the LS control tilting actuator 35*c* constitute load sensing pump control means that controls tilting of the main pump 2 such that the delivery pressure Pd of the main pump 2 is higher by the target differential pressure for load sensing control than the maximum load pressure PLmax of the actuators 5, 6, 7, 8, 9, 10, 11, 12.

It is here noted that the absolute pressure Pa varies according to the engine speed. Control of actuator speed according to the engine speed can therefore be performed by using the absolute pressure Pa as the target differential pressure for load sensing control and setting the target compensating differential pressure of the pressure compensating valves 27*a* to 27*h* using the absolute pressure PLS of the differential pressure between the delivery pressure Pd of the main pump 2 and the maximum load pressure PLmax. In addition, the variable throttle portion 30*c* of the flow rate detecting valve 30*a* of the engine speed detecting valve device 30 is configured such that the more the passing flow rate, the milder the rate of increase in the differential pressure thereacross as described earlier. This improves a saturation phenomenon according to the engine speed and good fine operability can be achieved when the engine speed is set low.

The spring 25*a* of the unloading valve 25 has a resilience that is set to higher than the absolute pressure Pa (the target differential pressure for load sensing control) generated by the differential pressure reducing valve 30*b* of the engine speed detecting valve device 30 when the engine 1 runs at its rated maximum speed.

The hydraulic drive system shown in FIGS. 1A and 1B represents a condition in which a speed of the left track motor 6 is lower than a speed of the right track motor 8 when control levers of the control lever devices 34*b*, 34*d* for tracks are operated all the way in the right direction shown in the figures with an intention of traveling in a straight-ahead direction. The hydraulic drive system includes a flow rate correction device 39 on the side on which the valve opening-side pressure receiving portion 28*b* for setting the target differential pressure of the pressure compensating valve 27*b* for the left track is disposed. The flow rate correction device 39 limits a maximum flow rate output from the flow control valve 26*b* to a predetermined flow rate. The flow rate correction device 39 according this embodiment serves as a target compensating differential pressure adjusting device that corrects the target compensating differential pressure of the pressure compensating valve 27*b* for track using a biasing force of a target compensating differential pressure adjusting spring 36*b*. The target compensating differential pressure of the pressure compensating valve 27*b* for the left track is adjusted using this target compensating differential pressure adjusting device to thereby correct the maximum flow rate of the flow control valve 26*b*.

Figure 2A:
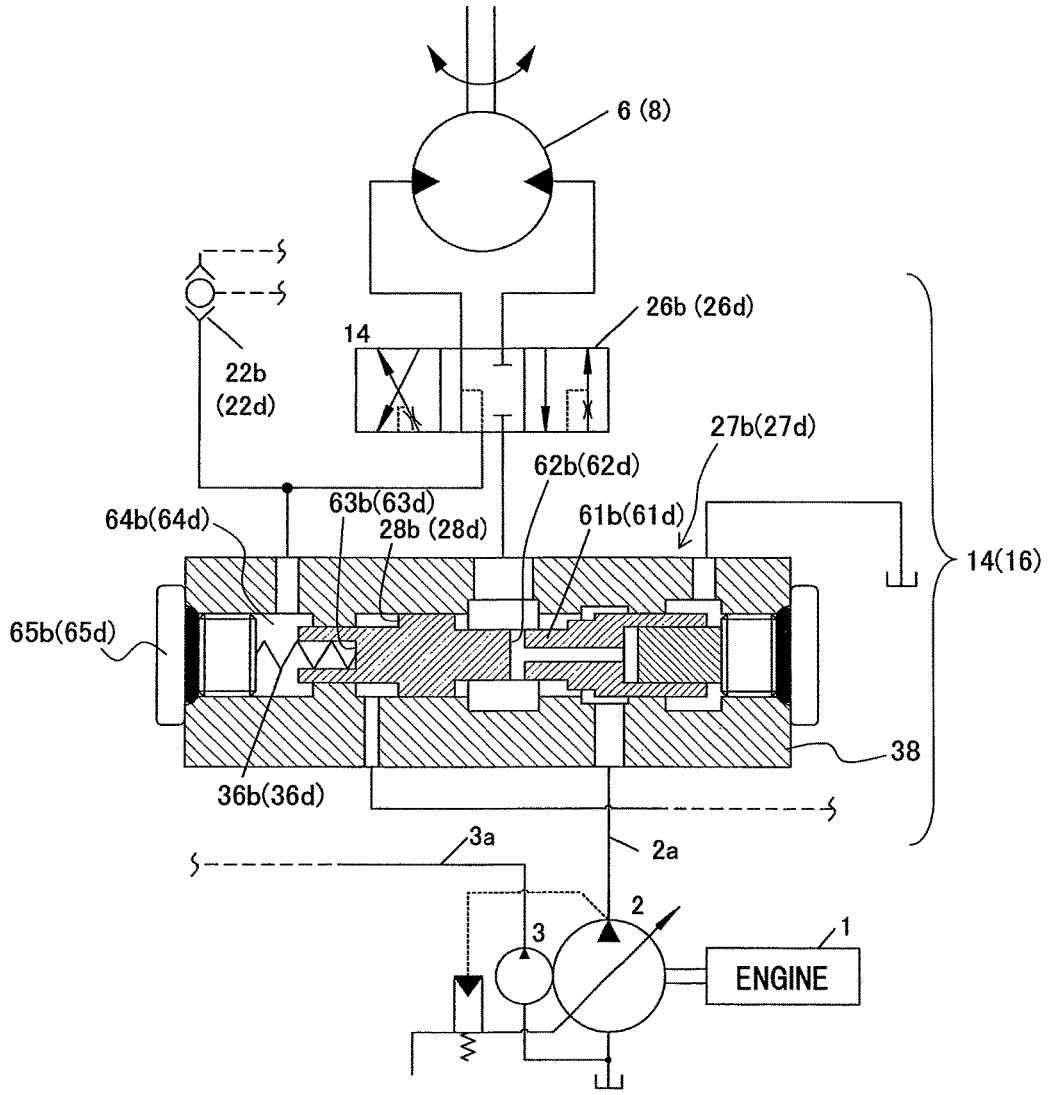
FIG. 2A is a cross-sectional view showing a pressure compensating valve portion in the first embodiment of the present invention.
Figure 2B:
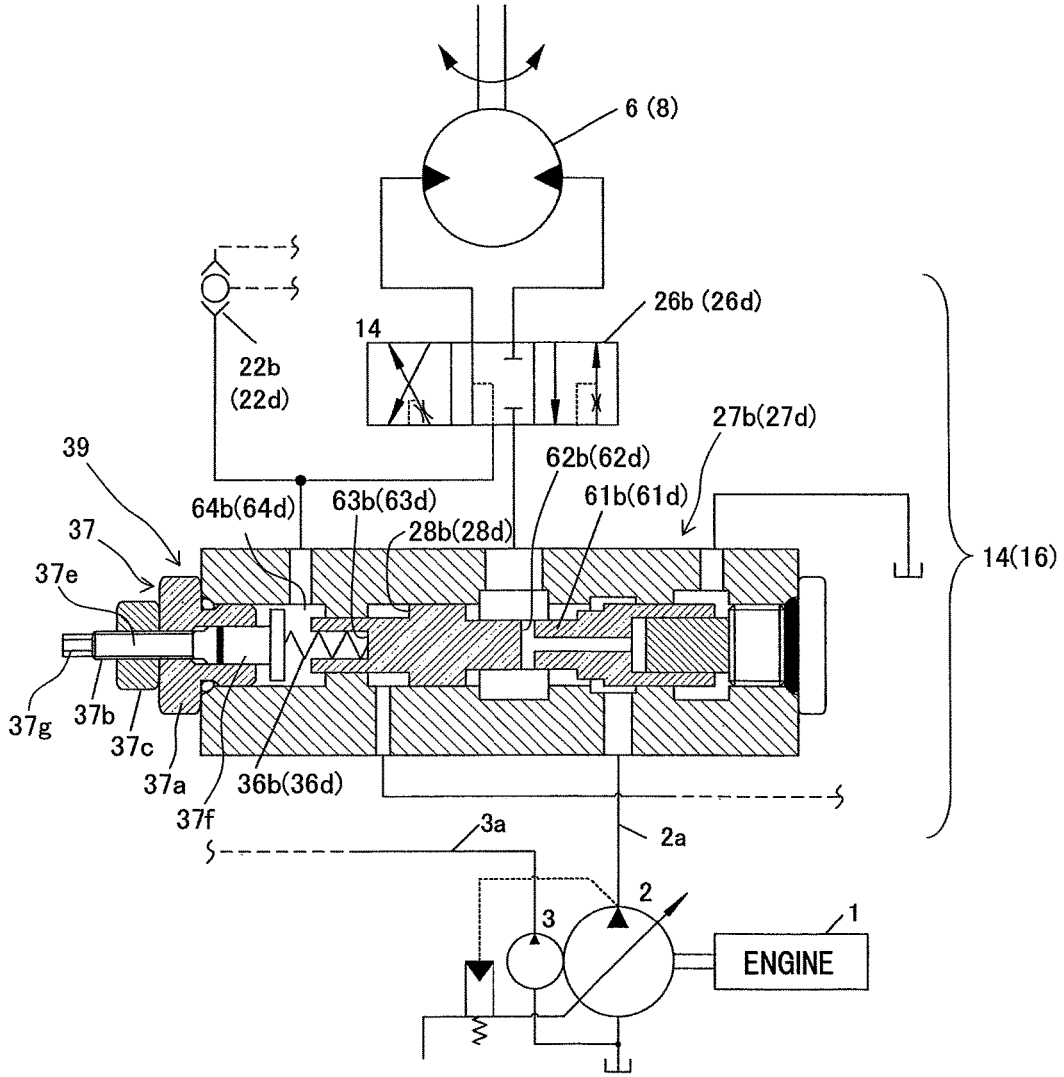
FIG. 2B is a cross-sectional view showing the pressure compensating valve portion in the first embodiment of the present invention.

The flow rate correction device 39 (target compensating differential pressure adjusting device) will be described in detail with reference to FIGS. 2A and 2B. FIG. 2A is a cross-sectional view showing the pressure compensating valves 27*b*, 27*d* for ordinary left and right tracks having no flow rate correction device 39. FIG. 2B is a cross-sectional view showing the pressure compensating valves 27*b*, 27*d* for left and right tracks having the flow rate correction device 39. In FIGS. 2A and 2B, the reference numerals for the right track motor 8, the flow control valve 26*d* for the right track, and the pressure compensating valve 27*d* for the right track are shown in parentheses.

Referring to FIG. 2A, the pressure compensating valves 27*b*, 27*d* for the left and right tracks each include a valve element 61*b*, a valve closing-side pressure receiving portion 62*b* and a valve opening-side pressure receiving portion 63*b* for feedback, and the abovementioned valve opening-side pressure receiving portion 28*b* for setting the target differential pressure. Specifically, the valve element 61*b* is inserted slidably in an axial direction (crosswise direction in the figure) in a pressure compensating valve portion of a housing 38 of the track valve sections 14, 16 of the control valve 4. The valve closing-side pressure receiving portion 62*b* and the valve opening-side pressure receiving portion 63*b* are disposed in the valve element 61*b*. Pressure upstream of the flow control valve 26 and pressure downstream thereof (load pressure of the left track motor 6) are introduced to the valve closing-side pressure receiving portion 62*b* and the valve opening-side pressure receiving portion 63*b*, respectively. The valve opening-side pressure receiving portion 28*b* is disposed in the valve element 61*a*. An output pressure of the differential pressure reducing valve 24 (see FIGS. 1A and 1B) is introduced to the valve opening-side pressure receiving portion 28*b*. A pressure receiving chamber 64*b* in which the valve opening-side pressure receiving portion 63*b* for feedback is disposed is closed by a plug 65*b*. Additionally, the target compensating differential pressure adjusting spring 36*b* biasing in the valve opening direction is disposed in the pressure receiving chamber 64*b*.

The pressure compensating valve 27*d* for the right track is arranged similarly, including a valve element 61*d*, a valve closing-side pressure receiving portion 62*d* and a valve opening-side pressure receiving portion 63*d* for feedback, the valve opening-side pressure receiving portion 28*d* for setting the target differential pressure, a pressure receiving chamber 64*d*, a plug 65*d*, and a target compensating differential pressure adjusting spring 36*d*.

The target compensating differential pressure adjusting springs 36*b*, 36*d* supply hydraulic fluid preferentially to the track motors 6, 8 during the combined operation for traveling to thereby stabilize traveling. In this embodiment, the target compensating differential pressure adjusting springs 36*b*, 36*d* are used for correcting the target compensating differential pressure of the pressure compensating valve 27*b* in the flow rate correction device 39. It is noted that some types of pressure compensating valves do not include the target compensating differential pressure adjusting springs 36*b*, 36*d*, in which case, a target compensating differential pressure adjusting spring dedicated to the purpose may be newly incorporated.

Referring to FIG. 2B, the flow rate correction device 39 (target compensating differential pressure adjusting device) is configured with an adjusting mechanism-mounted plug 37 that adjusts the biasing force of the target compensating differential pressure adjusting spring 36*b*. The adjusting mechanism-mounted plug 37 adjusts the maximum flow rate of the flow control valve 26*b*. The adjusting mechanism-mounted plug 37 includes a plug main unit 37*a*, an adjusting pin 37*b* built into the plug main unit 37*a*, and a lock nut 37*c*. The plug main unit 37*a* has a screw size identical to that of the plug 65*b*. The adjusting pin 37*b* includes a male threaded portion 37*e*, a spring seat 37*f*, and a tool operating portion 37*g*. Specifically, the male threaded portion 37*e* threaded engages the plug main unit 37*a*. The spring seat 37*f* protrudes into the pressure receiving chamber 64*d* and engages the target compensating differential pressure adjusting spring 36*b*. The tool operating portion 37*g* protrudes toward a side opposite to the pressure receiving chamber 64*d* and has a hexagonal cross section. A box wrench or other tool is mounted on the tool operating portion 37*g* and then turned to thereby vary an axial position of the adjusting pin 37*b*. The biasing force of the target compensating differential pressure adjusting spring 36*b* is thus adjusted and the target compensating differential pressure of the pressure compensating valve 27*b* is adjusted accordingly. After the target compensating differential pressure has been adjusted, the lock nut 37*c* is tightened to thereby fix the position of the adjusting pin 37*b*. This completes the adjustment of the target compensating differential pressure.

Functions of this embodiment will be described below.

In this embodiment, the ordinary pressure compensating valve 27*b* not having the flow rate correction device 39 shown in FIG. 2A is mounted as the pressure compensating valve 27*b* for the left track before the product inspection performed upon shipment from the factory. When the control levers of the control lever devices 34*b*, 34*d* for tracks are operated all the way in the right direction shown in figure with the intention of traveling in a straight-ahead direction in such a hydraulic drive system, control pilot pressures d, h for operating the flow control valves 26*b*, 26*d* are generated from the hydraulic fluid of the pilot hydraulic fluid source 33 and introduced to the flow control valves 26*b*, 26*d*. The hydraulic fluid delivered from the main pump 2 is introduced to the left and right track motors 6, 8 via the pressure compensating valves 27*b*, 27*d* and the flow control valves 26*b*, 26*d*.

Actuator load pressures of the left and right track motors 6, 8 introduced to the valve opening-side pressure receiving portions 28*b*, 28*d* of the pressure compensating valves 27*b*, 27*d* for the left and right tracks are, by their nature, equal to each other at the time. In rare cases, however, machine weight balance or manufacturing errors involved in the track motors may result in different actuator load pressures, so that a difference in speed occurs between the left and right track motors 6, 8, causing skew to occur.

A traveling test upon shipment from the factory is conducted through the operation described above. If skew occurs, the following corrections are to be made.

The plug 65*b* mounted on the side of the valve opening-side pressure receiving portion 28*b* (or 28*d*) of the pressure compensating valve 27*b* (or 27*d*) for the track corresponding to a slower speed is removed. As shown in FIG. 2B, the adjusting mechanism-mounted plug 37 is then mounted and the adjusting pin 37*b* of the adjusting mechanism-mounted plug 37 is operated to be moved in the right direction as described earlier to thereby strengthen the biasing force of the target compensating differential pressure adjusting spring 36*b*. The opening in the pressure compensating valve 27*b* (or 27*d*) is thereby corrected in the opening direction, so that the flow rate to the left track motor 6 (or 8) is equalized to that to the right track motor 8 (or 6). This allows skew traveling to be corrected for straight line traveling.

As described heretofore, this embodiment allows skew traveling to be easily corrected for straight line traveling without having to replace a track motor or other large-size device. Skew traveling can also be easily corrected for straight line traveling without having to modify specially the main circuit.

Second Embodiment

Figure 4A:
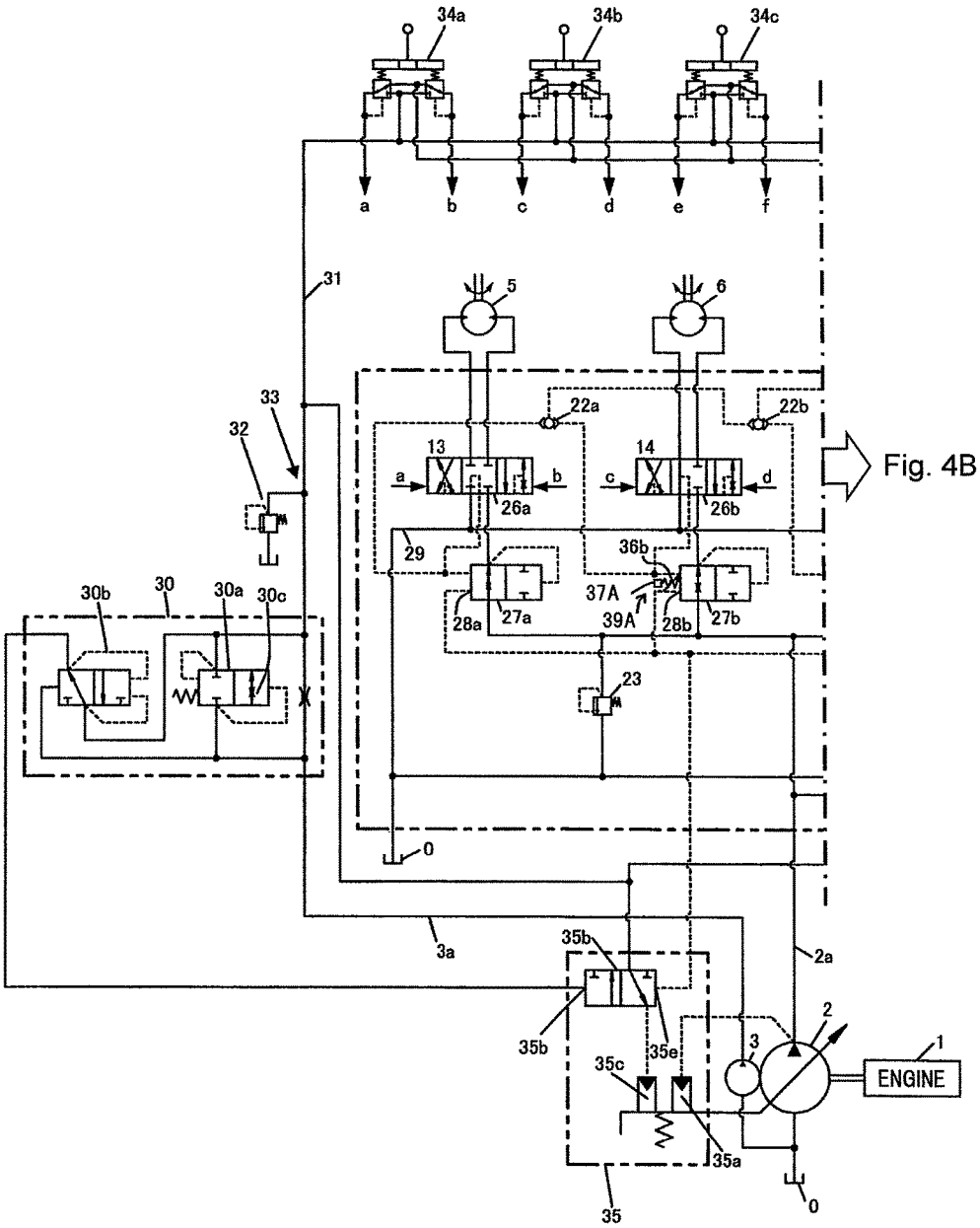
FIG. 4A is a diagram showing a left-hand half of a hydraulic drive system according to a second embodiment of the present invention.
Figures 4A, 4B:
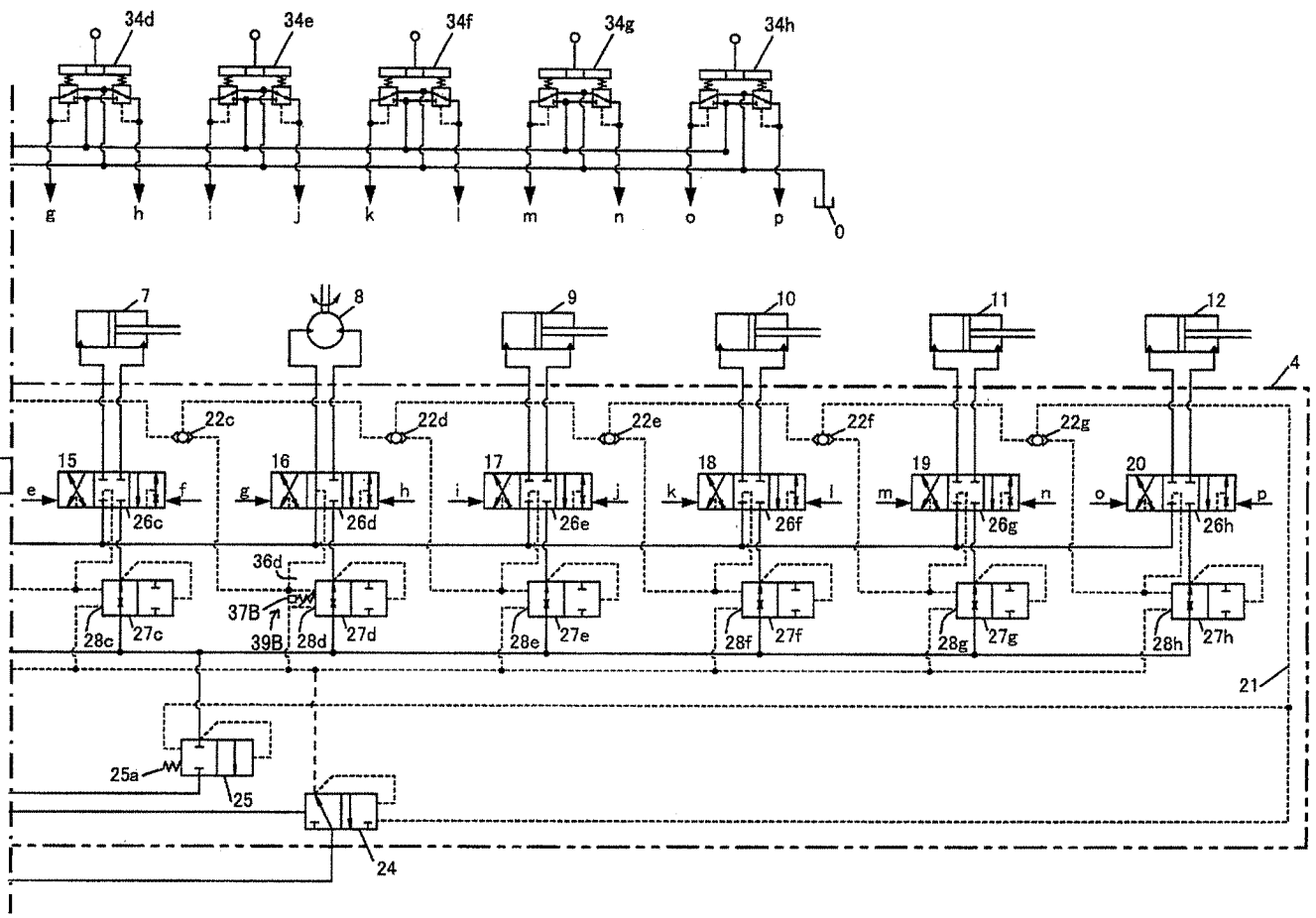
FIG. 4B is a diagram showing a right-hand half of the hydraulic drive system according to the second embodiment of the present invention.

FIGS. 4A and 4B show a hydraulic drive system for a working machine according to a second embodiment of the present invention.

In the first embodiment, the flow rate correction device 39 (target compensating differential pressure adjusting device) is mounted for making adjustments, if a fault is found during the pre-shipment inspection. In the second embodiment, by contrast, flow rate correction devices 39A, 39B (target compensating differential pressure adjusting devices) are mounted in advance, in a hydraulic drive system for a working machine as a product for immediate shipment, in valve housings on the side of both of valve opening-side pressure receiving portions 28*b*, 28*d* of pressure compensating valves 27*b*, 27*d* for left and right tracks, so that an immediate adjustment can be made whenever necessary. The flow rate correction devices 39A, 39B (target compensating differential pressure adjusting devices) include adjusting mechanism-mounted plugs 37A, 37B, respectively, for adjusting biasing forces of target compensating differential pressure adjusting springs 36*b*, 36*d*, respectively. The adjusting mechanism-mounted plugs 37A, 37B are configured similarly to the adjusting mechanism-mounted plug 37 in the flow rate correction device 39 (target compensating differential pressure adjusting device) according to the first embodiment.

Other arrangements are similar to those in the first embodiment.

Functions of the second embodiment will be described below.

Initially, adjusting pins 37*b*, 37*b* (see FIG. 2B) of the adjusting mechanism-mounted plugs 37A, 37B are fixed at their initial positions to thereby set the biasing force of the target compensating differential pressure adjusting springs 36*b* to a specified value. When, under this condition, control levers of control lever devices 34*b*, 34*d* for tracks are operated all the way in the right direction shown in the figures with an intention of traveling in a straight-ahead direction, control pilot pressures d, h for operating the flow control valves 26*b*, 26*d* are generated from the hydraulic fluid of a pilot hydraulic fluid source 33 and introduced to the flow control valves 26*b*, 26*d*. The hydraulic fluid delivered from the main pump 2 is introduced to left and right track motors 6, 8 via the pressure compensating valves 27*b*, 27*d* and the flow control valves 26*b*, 26*d*.

Actuator load pressures of the left and right track motors 6, 8 introduced to the valve opening-side pressure receiving portions 28*b*, 28*d* of the pressure compensating valves 27*b*, 27*d* for the left and right tracks are, by their nature, equal to each other at the time. In rare cases, however, machine weight balance or manufacturing errors involved in the track motors may result in different actuator load pressures, so that a difference in speed (difference in revolutions per minute) occurs between the left and right track motors 6, 8, causing skew to occur.

A traveling test upon shipment from the factory is conducted through the operation described above. If skew occurs, the following corrections are to be made.

The adjusting pin 37*b* of the adjusting mechanism-mounted plug 37A (or 37B) mounted on the pressure compensating valve 27*b* (or 27*d*) for track whichever is lower in speed is operated to be moved in the right direction as described earlier to thereby strengthen the biasing force of the target compensating differential pressure adjusting spring 36*b* (or 36*d*). The opening in the pressure compensating valve 27*b* (or 27*d*) is thereby corrected in the opening direction, so that the flow rate to the left track motor 6 (or 8) is equalized to that to the right track motor 8 (or 6). This allows skew traveling to be corrected for straight line traveling.

In this embodiment, the flow rate correction devices 39A, 39B that include the adjusting mechanism-mounted plugs 37A, 37B for adjusting the biasing forces of the target compensating differential pressure adjusting springs 36*b*, 36*d* are mounted in advance on the pressure compensating valves 27*b*, 27*d* for the left and right tracks. This eliminates the need for replacing the ordinary plug 65*b* (or 65*d*) with the adjusting mechanism-mounted plug in the pressure compensating valve that has caused skew to occur. This enables prompt correction of skew traveling for straight line traveling. Additionally, the flow rate correction devices 39A, 39B are mounted on both of the pressure compensating valves 27*b*, 27*d* for the left and right tracks. This broadens a range of correction of skew traveling for straight line traveling.

As described heretofore, the same effects as in the first embodiment can be achieved also in this embodiment. Additionally, in this embodiment, there is no need to mount the flow rate correction device at the very time of making adjustments. This permits prompt correction of skew traveling for straight line traveling. Additionally, the flow rate correction devices 39A, 39B are mounted on both of the pressure compensating valves 27*b*, 27*d* for the left and right tracks. This broadens the range of correction of skew traveling for straight line traveling.

Third Embodiment

Figure 5A:
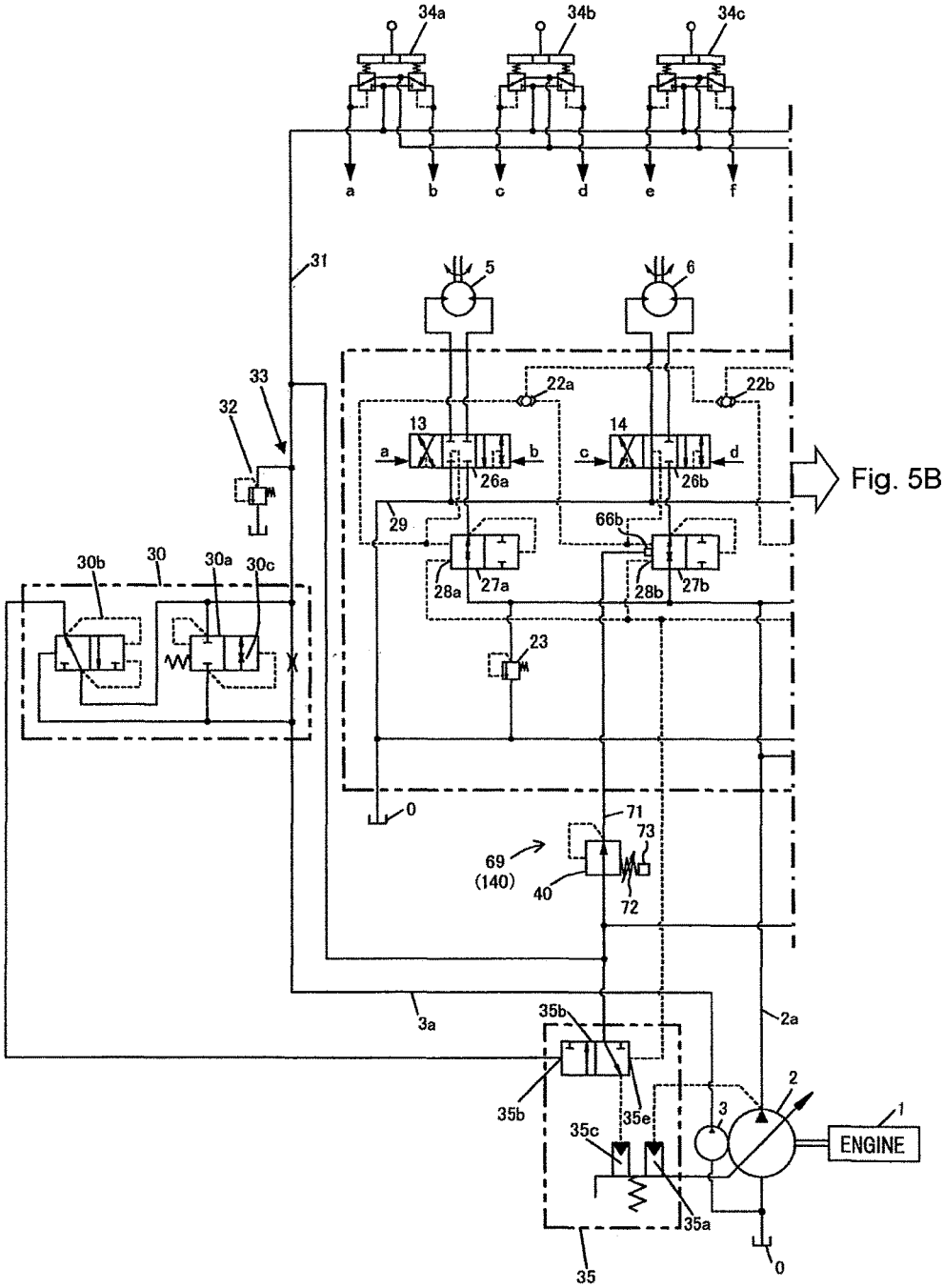
FIG. 5A is a diagram showing a left-hand half of a hydraulic drive system according to a third embodiment of the present invention.
Figures 5A, 5B:
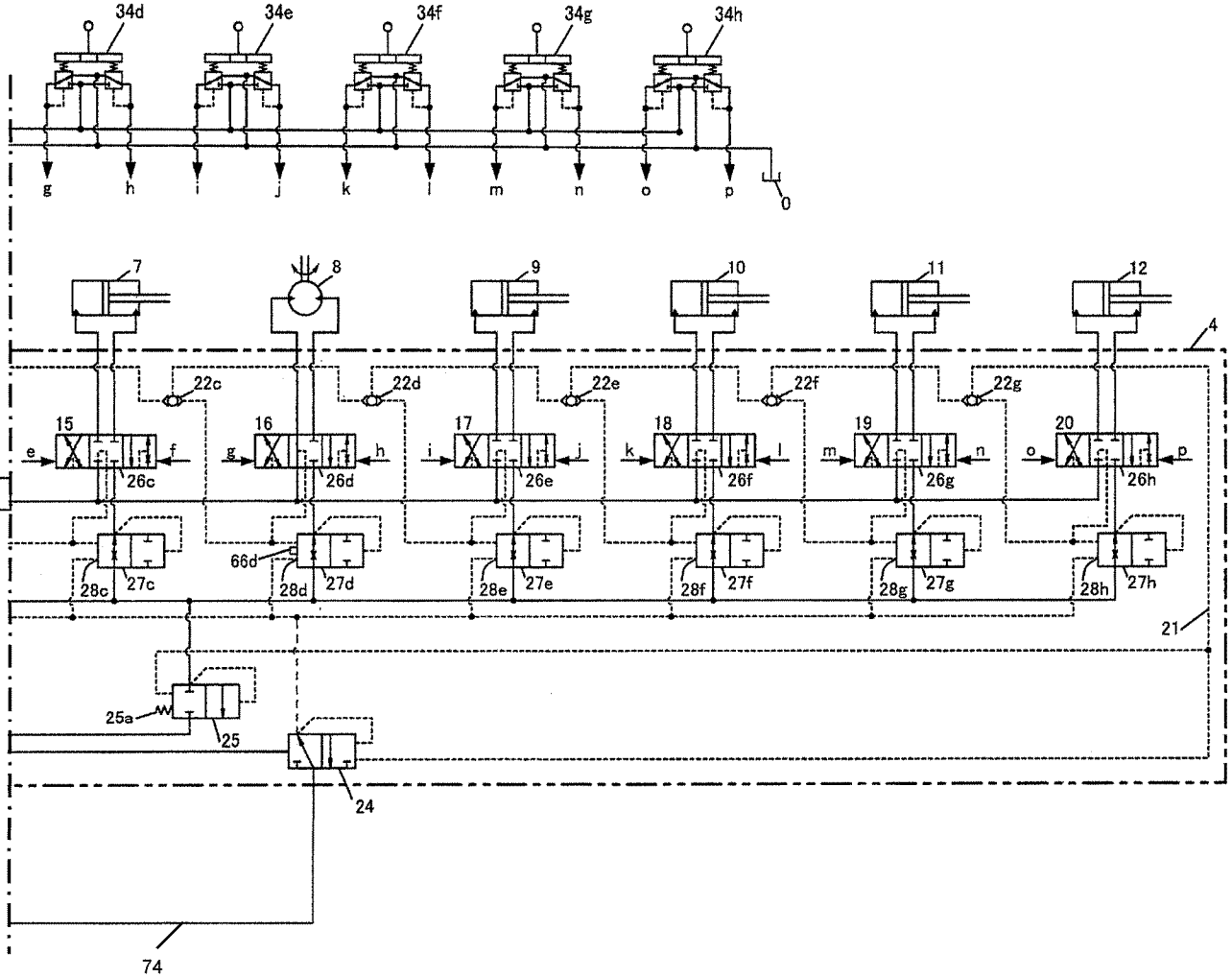
FIG. 5B is a diagram showing a right-hand half of the hydraulic drive system according to the third embodiment of the present invention.

FIGS. 5A and 5B show a hydraulic drive system for a working machine according to a third embodiment of the present invention.

In the first embodiment, the flow rate correction device 39 (target compensating differential pressure adjusting device) includes the adjusting mechanism-mounted plug 37 for adjusting the biasing force of the target compensating differential pressure adjusting spring 36*b* or 36*d*. In contrast, in this embodiment, a flow rate correction device 69 (target compensating differential pressure adjusting device) includes a pressure reducing valve unit 140 including a pressure reducing valve 40 that corrects a target compensating differential pressure of a pressure compensating valve 27*b* for the left track (or a pressure compensating valve 27*d* for the right track) by reducing pressure of a pilot hydraulic fluid source 33. The pressure reducing valve 40 includes an adjusting device (adjusting mechanism 73) for adjusting a maximum flow rate of a flow control valve 26*b* for the left track (or a flow control valve 26*d* for the right track).

Specifically, the hydraulic drive system shown in FIGS. 5A and 5B applies to a condition in which, when control levers of control lever devices 34*b*, 34*d* for tracks are operated all the way in the right direction shown in the figures with an intention of traveling in a straight-ahead direction, a left track motor 6 runs at a speed lower than a right track motor 8. The hydraulic drive system has the pressure reducing valve unit 140 connected thereto. The pressure reducing valve unit 140 includes the pressure reducing valve 40 disposed on the side on which a valve opening-side pressure receiving portion 28*b* for setting a target differential pressure of the pressure compensating valve 27*b* for the left track is disposed. The pressure reducing valve 40 corrects the target compensating differential pressure of the pressure compensating valve 27*b* for the left track by reducing the pressure of the pilot hydraulic fluid source 33. The pressure reducing valve unit 140 includes a line 71 in which the pressure reducing valve 40 is disposed. The line 71 has an upstream side connected to a hydraulic line 74 that introduces the hydraulic fluid from the pilot hydraulic fluid source 33 to a differential pressure reducing valve 24. The line 71 has a downstream side connected to a correction pressure receiving portion 66*b* disposed additionally on the side on which the valve opening-side pressure receiving portion 28*b* for setting the target differential pressure of the pressure compensating valve 27*b* is disposed. The pressure reducing valve 40 includes, as the adjusting device for adjusting the maximum flow rate of the flow control valve 26*b*, the adjusting mechanism 73 that adjusts the biasing force of a spring 72 for setting a pressure reducing valve output pressure.

Similarly to the adjusting mechanism-mounted plug 37 shown in FIG. 2B, the adjusting mechanism 73 includes an adjusting pin and a lock nut, not shown and built into the pressure reducing valve 40. The pressure reducing valve 40 generates hydraulic fluid with a pressure corresponding to the setting of the spring 72 based on the hydraulic fluid from the pilot hydraulic fluid source 33. The pressure reducing valve 40 then introduces the hydraulic fluid to the correction pressure receiving portion 66*b* of the pressure compensating valve 27*b* for track to thereby adjust the target compensating differential pressure during traveling.

Other arrangements are the same as those of the first embodiment.

Functions of the third embodiment will be described below.

When the control levers of the control lever devices 34*b*, 34*d* for the tracks are operated all the way in the right direction shown in the figures with an intention of traveling in a straight-ahead direction, control pilot pressures d, h for operating the flow control valves 26*b*, 26*d* are generated from the hydraulic fluid of the pilot hydraulic fluid source 33 and introduced to the flow control valves 26*b*, 26*d*. The hydraulic fluid delivered from a main pump 2 is introduced to the left and right track motors 6, 8 via the pressure compensating valves 27*b*, 27*d* and the flow control valves 26*b*, 26*d*.

Actuator load pressures of the left and right track motors 6, 8 introduced to the valve opening-side pressure receiving portions 28*b*, 28*d* of the pressure compensating valves 27*b*, 27*d* for the left and right tracks are, by their nature, equal to each other at this time. In rare cases, however, machine weight balance or manufacturing errors involved in the track motors may result in different actuator load pressures, so that a difference in speed (difference in revolutions per minute) occurs between the left and right track motors 6, 8, causing skew to occur.

A traveling test upon shipment from the factory is conducted through the operation described above. If skew occurs, the pressure reducing valve unit 140 is connected to the side on which the valve opening-side pressure receiving portion 28*b* (or 28*d*) of the pressure compensating valve 27*b* (or 27*d*) for track whichever is lower in speed is disposed. An arrangement is thus established in which the hydraulic fluid from the hydraulic line 39 is subjected to reduction in pressure by the pressure reducing valve 40 before being introduced to the correction pressure receiving portion 66*b* (or 66*d*). The adjusting pin of the adjusting mechanism 73 of the pressure reducing valve 40 is then operated to thereby strengthen the biasing force of the spring 72. The output pressure is thus increased and the opening in the pressure compensating valve 27*b* (or 27*d*) is corrected in the opening direction. The flow rate to the left track motor 6 (or 8) is thus adjusted so as to be equal to the flow rate to the right track motor 8 (or 6). This corrects skew traveling for straight line traveling.

As described heretofore, the same effects as in the first embodiment can be achieved also in this embodiment.

Fourth Embodiment

Figure 6A:
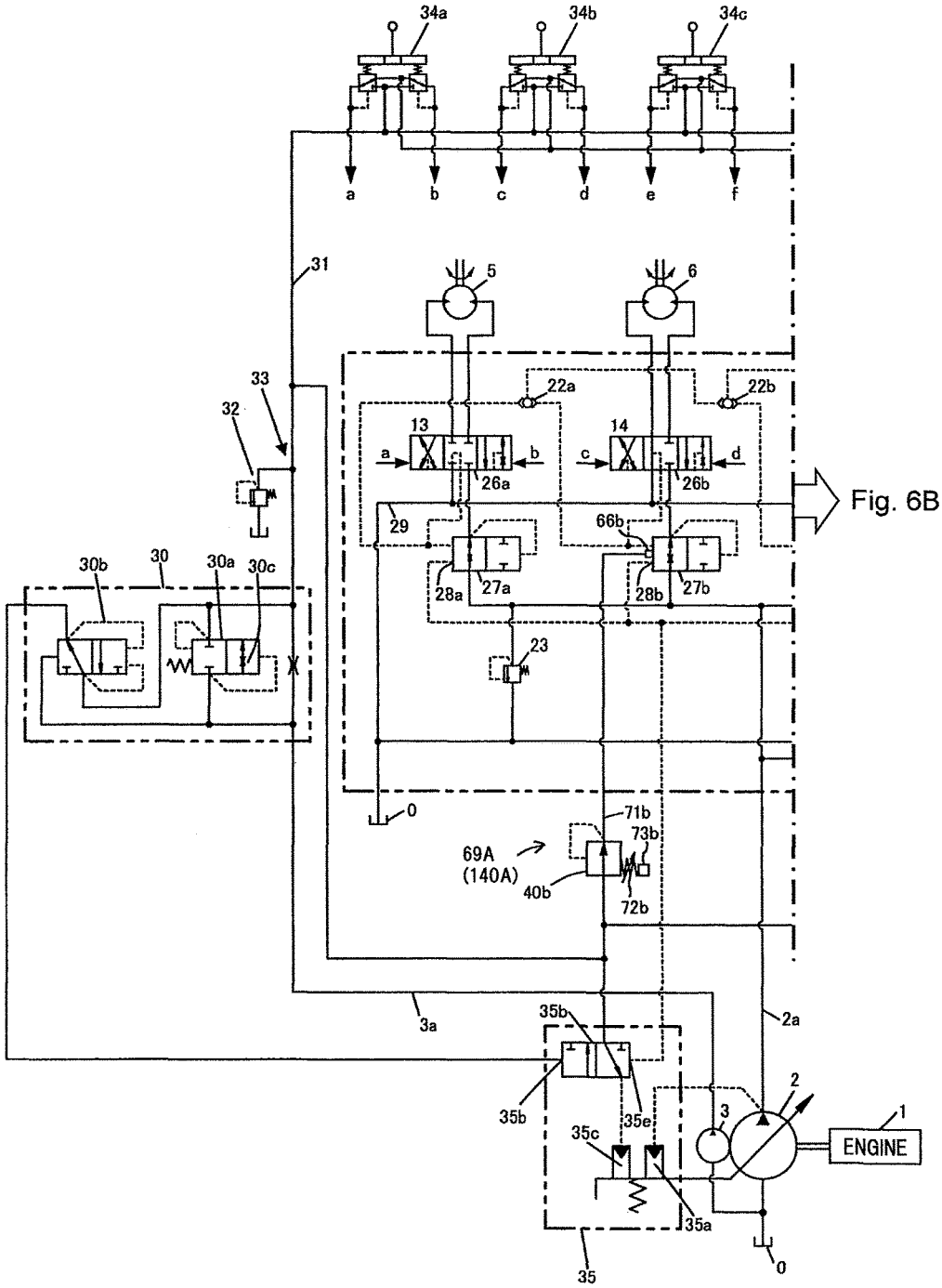
FIG. 6A is a diagram showing a left-hand half of a hydraulic drive system according to a fourth embodiment of the present invention.
Figure 6B:
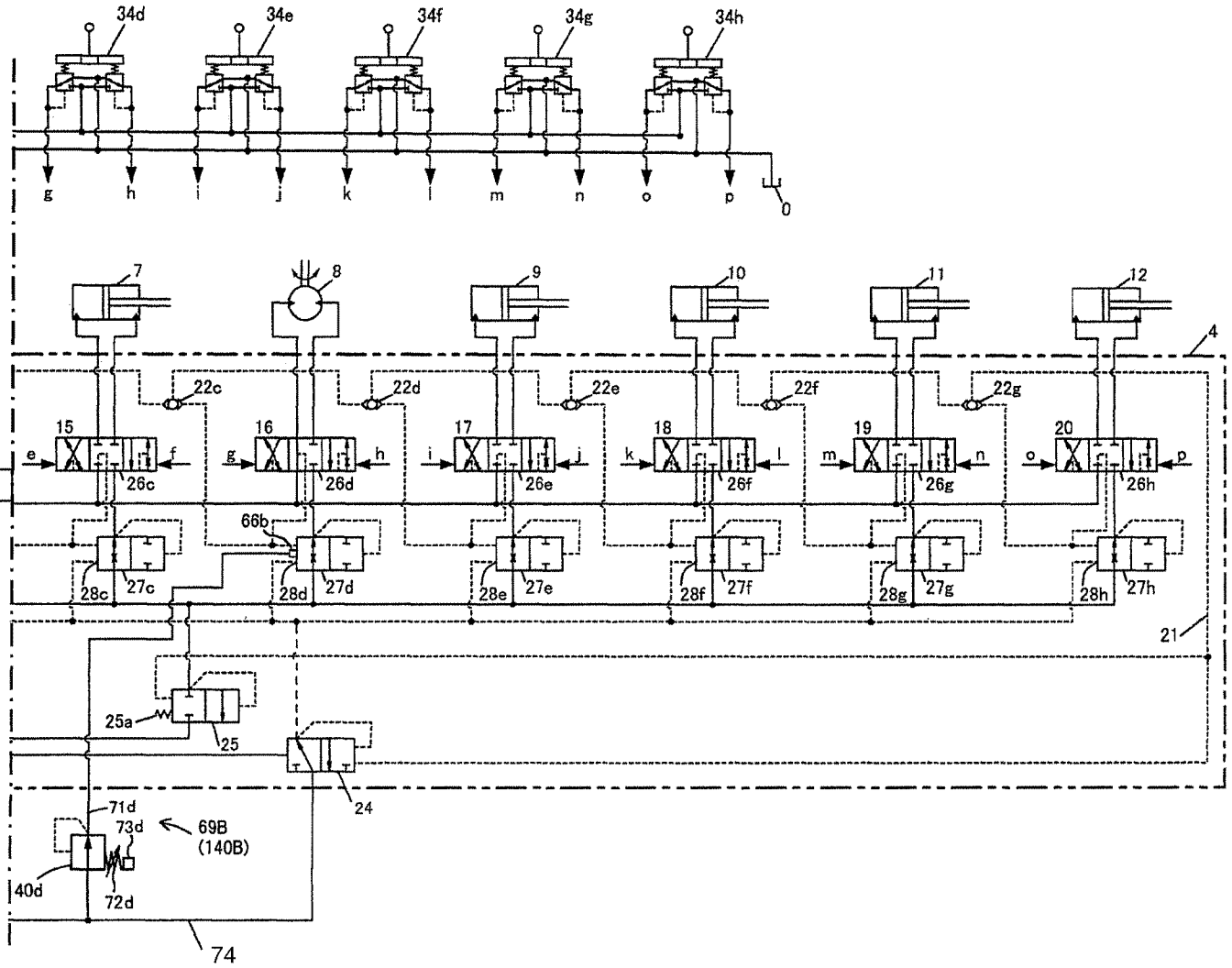
FIG. 6B is a diagram showing a right-hand half of the hydraulic drive system according to the fourth embodiment of the present invention.

FIGS. 6A and 6B show a hydraulic drive system for a working machine according to a fourth embodiment of the present invention.

In the third embodiment, the pressure reducing valve unit 140 as the flow rate correction device 69 (target compensating differential pressure adjusting device) is connected for making adjustments, if a fault is found during the pre-shipment inspection. In the fourth embodiment, by contrast, pressure reducing valve units 140A, 140B as flow rate correction devices 69A, 69B (target compensating differential pressure adjusting devices) are connected in advance, in the hydraulic drive system for a working machine as a product for immediate shipment, in valve housings on the side of both of valve opening-side pressure receiving portions 28*b*, 28*d* of pressure compensating valves 27*b*, 27*d* for left and right tracks, so that an immediate adjustment can be made whenever necessary. The pressure reducing valve units 140A, 140B are configured similarly to the pressure reducing valve unit 140 of the third embodiment and include pressure reducing valves 40*b*, 40*d* and lines 71*b*, 71*d* in which the pressure reducing valves 40*b*, 40*d* are disposed, respectively. The lines 71*b*, 71*d* have upstream sides connected to a hydraulic line 39 that introduces the hydraulic fluid from a pilot hydraulic fluid source 33 to a differential pressure reducing valve 24. The lines 71*b*, 71*d* have downstream sides connected to correction pressure receiving portions 66*b*, 66*d* disposed additionally on the side on which valve opening-side pressure receiving portions 28*b*, 28*d* for setting the target differential pressure of pressure compensating valves 27*b*, 27*d* are disposed. The pressure reducing valves 40*b*, 40*d* include, as the adjusting device for adjusting the maximum flow rate of flow control valves 26*b*, 26*d*, adjusting mechanisms 73*b*, 73*d* that adjust biasing forces of springs 72*b*, 72*d* for setting pressure reducing valve output pressures.

Other arrangements are the same as those of the third embodiment.

Functions of the fourth embodiment will be described below.

Initially, the springs 72*b*, 72*d* of the pressure reducing valves 40*b*, 40*d* are set to zero to thereby set the output pressure of the pressure reducing valves 40*b*, 40*d* at the tank pressure. When, under this condition, control levers of control lever devices 34*b*, 34*d* for tracks are operated all the way in the right direction shown in the figures with an intention of traveling in a straight-ahead direction, control pilot pressures d, h for operating the flow control valves 26*b*, 26*d* are generated from the hydraulic fluid of the pilot hydraulic fluid source 33 and introduced to the flow control valves 26*b*, 26*d*. The hydraulic fluid delivered from a main pump 2 is introduced to left and right track motors 6, 8 via the pressure compensating valves 27*b*, 27*d* and the flow control valves 26*b*, 26*d*.

Actuator load pressures of the left and right track motors 6, 8 introduced to the valve opening-side pressure receiving portions 28*b*, 28*d* of the pressure compensating valves 27*b*, 27*d* for the left and right tracks are, by their nature, equal to each other at this time. In rare cases, however, machine weight balance or manufacturing errors involved in the track motors may result in different actuator load pressures, so that a difference in speed (difference in revolutions per minute) occurs between the left and right track motors 6, 8, causing skew to occur.

A traveling test upon shipment from the factory is conducted through the operation described above. If skew occurs, the adjusting pin is operated of the adjusting mechanism 73*b* (or 73*d*) of the pressure reducing valve 40*b* (or 40*d*) of the pressure reducing valve unit 140A (or 140B) that is connected to the side on which the valve opening-side pressure receiving portion 28*b* (or 28*d*) of the pressure compensating valve 27*b* (or 27*d*) for track whichever is lower in speed is disposed. The biasing force of the spring 72*b* (or 72*d*) is thereby strengthened. The output pressure is thus increased and the opening in the pressure compensating valve 27*b* (or 27*d*) is corrected in the opening direction. The flow rate to the left track motor 6 (or 8) is thus adjusted so as to be equal to the flow rate to the right track motor 8 (or 6). This allows skew traveling to be corrected for straight line traveling.

In this embodiment, the pressure reducing valve units 140A, 140B are mounted in advance on both of the pressure compensating valves 27*b*, 27*d* for the left and right tracks, which eliminates the need for additionally mounting a pressure reducing valve unit when skew occurs. This enables prompt correction of skew traveling for straight line traveling. Additionally, the pressure reducing valve units 140A, 140B (flow rate correction device or target compensating differential pressure adjusting device) are mounted on both of the pressure compensating valves 27*b*, 27*d* for the left and right tracks. This broadens a range of correction of skew traveling for straight line traveling.

As described heretofore, the same effects as in the first embodiment can be achieved also in this embodiment. Additionally, in this embodiment, there is no need to mount the flow rate correction device at the very time of making adjustments. This permits prompt correction of skew traveling for straight line traveling. Additionally, the pressure reducing valve units 140A, 140B (flow rate correction device or target compensating differential pressure adjusting device) are mounted on both of the pressure compensating valves 27*b*, 27*d* for the left and right tracks. This broadens the range of correction of skew traveling for straight line traveling.

Fifth Embodiment

Figure 7A:
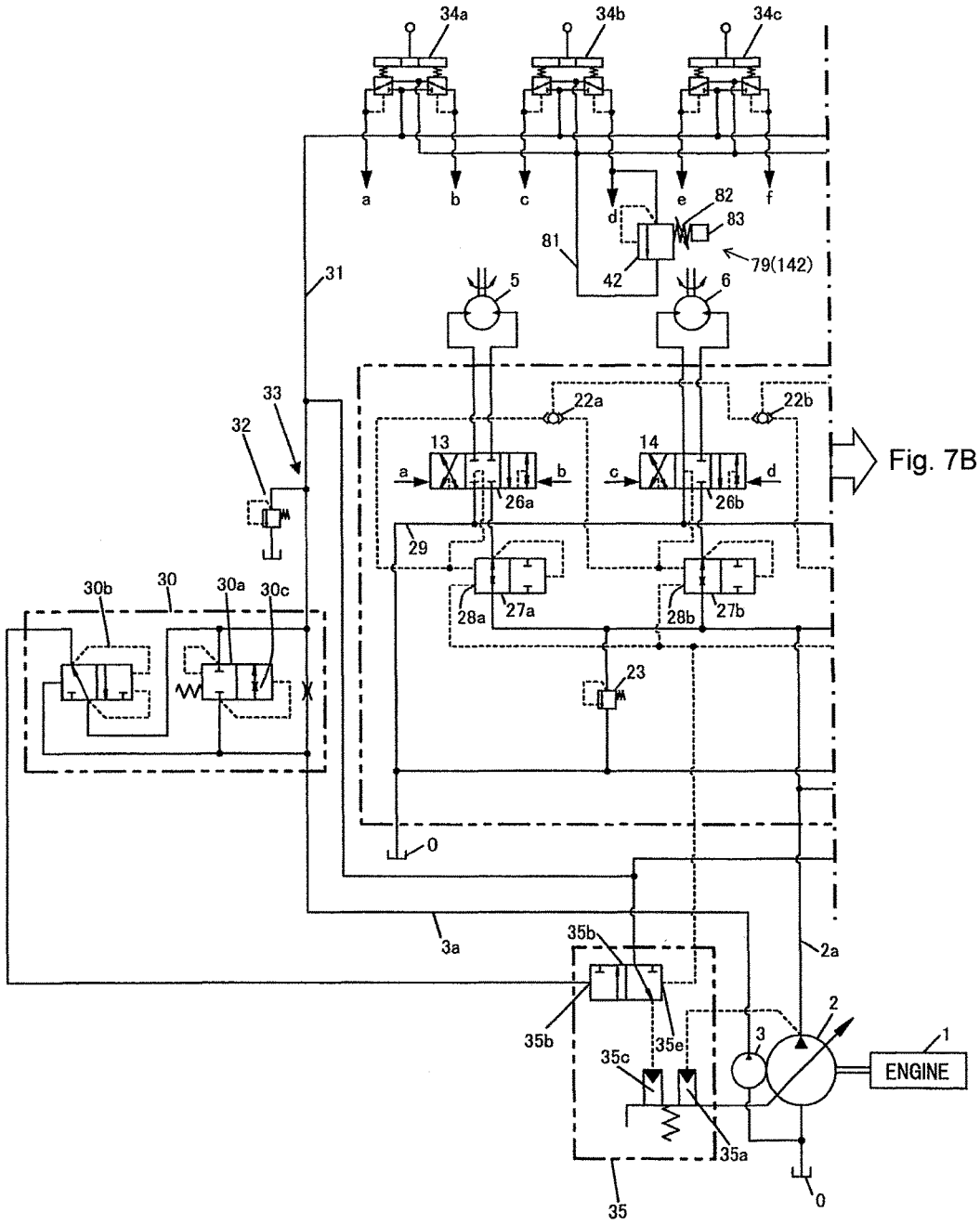
FIG. 7A is a diagram showing a left-hand half of a hydraulic drive system according to a fifth embodiment of the present invention.
Figures 7A, 7B:
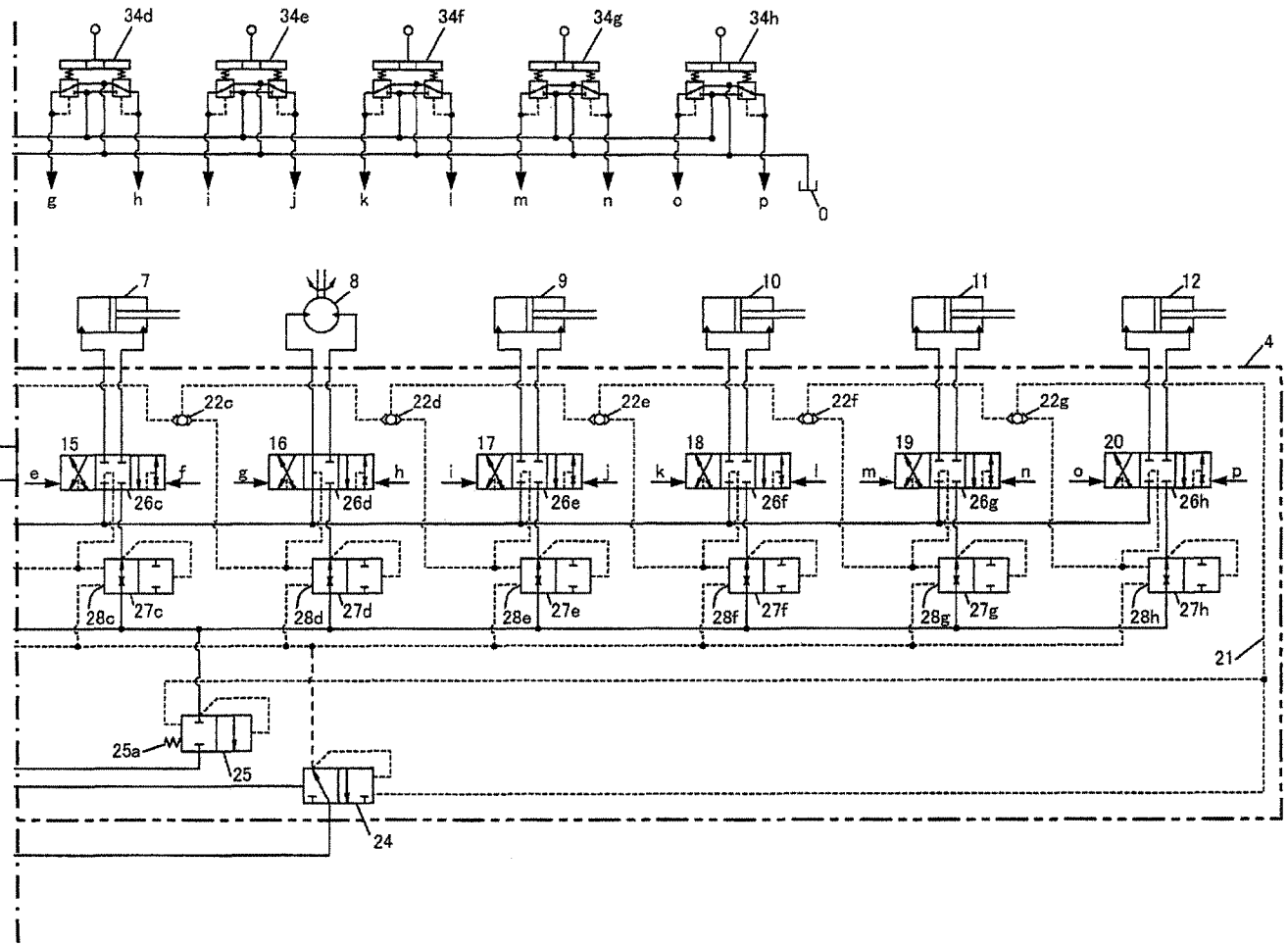
FIG. 7B is a diagram showing a right-hand half of the hydraulic drive system according to the fifth embodiment of the present invention.

FIGS. 7A and 7B show a hydraulic drive system for a working machine according to a fifth embodiment of the present invention.

In the first to fourth embodiments, the flow rate correction devices 39, 69 are configured with the respective target compensating differential pressure adjusting devices. In this embodiment, in contrast, a flow rate correction device 79 is configured with a pressure control valve unit 142 that is disposed between a remote control valve of a control lever device 34*b* (or 34*d*) for track and a flow control valve 26*b* (or 26*d*) and includes a pressure control valve 42 for reducing a control pilot pressure of the remote control valve. The pressure control valve 42 includes an adjusting device (an adjusting mechanism 83) for adjusting a maximum flow rate of the flow control valve 26*b* for the left track (or the flow control valve 26*d* for the right track).

Specifically, the hydraulic drive system shown in FIGS. 7A and 7B applies to a condition in which, when control levers of the control lever devices 34*b*, 34*d* for tracks are operated all the way in the right direction shown in the figures with an intention of traveling in a straight-ahead direction, a left track motor 6 runs at a speed higher than a right track motor 8. The hydraulic drive system includes the pressure control valve unit 142 connected to a line that introduces, of control pilot pressures c, d generated by the remote control valve of the control lever device 34*b* for the left track, the control pilot pressure d for a forward travel to the flow control valve 26*b*. The pressure control valve unit 142 includes the pressure control valve 42 that reduces the control pilot pressure d for a forward travel. The pressure control valve unit 142 includes a line 81 in which the pressure control valve 42 is disposed. The line 81 has an upstream side connected to the remote control valve of the control lever device 34*b* for the left track that outputs the control pilot pressure d for a forward travel and a downstream side connected to a tank line. The pressure control valve 42 is a variable relief valve that includes, as the adjusting device for adjusting the maximum flow rate of the flow control valve 26*b*, the adjusting mechanism 83 that adjusts a biasing force of a spring 82 for setting a relief pressure.

Similarly to the adjusting mechanism-mounted plug 37 shown in FIG. 2B, the adjusting mechanism 83 includes an adjusting pin and a lock nut, not shown and built into the pressure control valve 42. The pressure control valve 42 limits a maximum pressure of the control pilot pressure d for a forward travel generated by the remote control valve of the control lever device 34*b* for the left track to a pressure corresponding to the setting of the spring 82. A stroke of the flow control valve 26*b* is thereby restricted for a controlled flow rate.

Other arrangements are the same as those of the first embodiment.

Functions of the fifth embodiment will be described below.

When the control levers of control lever devices 34*b*, 34*d* for tracks are operated all the way in the right direction shown in the figures with an intention of traveling in a straight-ahead direction, control pilot pressures d, h for operating the flow control valves 26*b*, 26*d* are generated from the hydraulic fluid of a pilot hydraulic fluid source 33 and introduced to the flow control valves 26*b*, 26*d*. The hydraulic fluid delivered from a main pump 2 is introduced to the left and right track motors 6, 8 via pressure compensating valves 27*b*, 27*d* and the flow control valves 26*b*, 26*d*.

Actuator load pressures of the left and right track motors 6, 8 introduced to valve opening-side pressure receiving portions 28*b*, 28*d* of the pressure compensating valves 27*b*, 27*d* for the left and right tracks are, by their nature, equal to each other at this time. In rare cases, however, machine weight balance or manufacturing errors involved in the track motors may result in different actuator load pressures, so that a difference in speed (difference in revolutions per minute) occurs between the left and right track motors 6, 8, causing skew to occur.

A traveling test upon shipment from the factory is conducted through the operation described above. If skew occurs, the pressure control valve unit 142 is connected across the line that introduces the control pilot pressure d (or h) for operating the flow rate control valve whichever is higher in speed to the flow control valve 26*b* (or 26*d*) and the tank line. The adjusting pin of the adjusting mechanism 83 of the pressure control valve 42 is then operated in order to weaken the biasing force of the spring 82. The control pilot pressure d (or h) is thereby reduced and the stroke of the flow control valve 26*b* (or 26*d*) is thus restricted, so that the output flow rate of the flow control valve 26*b* (or 26*d*) is adjusted. This allows skew traveling to be corrected for straight line traveling.

As described heretofore, the same effects as in the first embodiment can be achieved also in this embodiment.

Sixth Embodiment

Figure 8A:
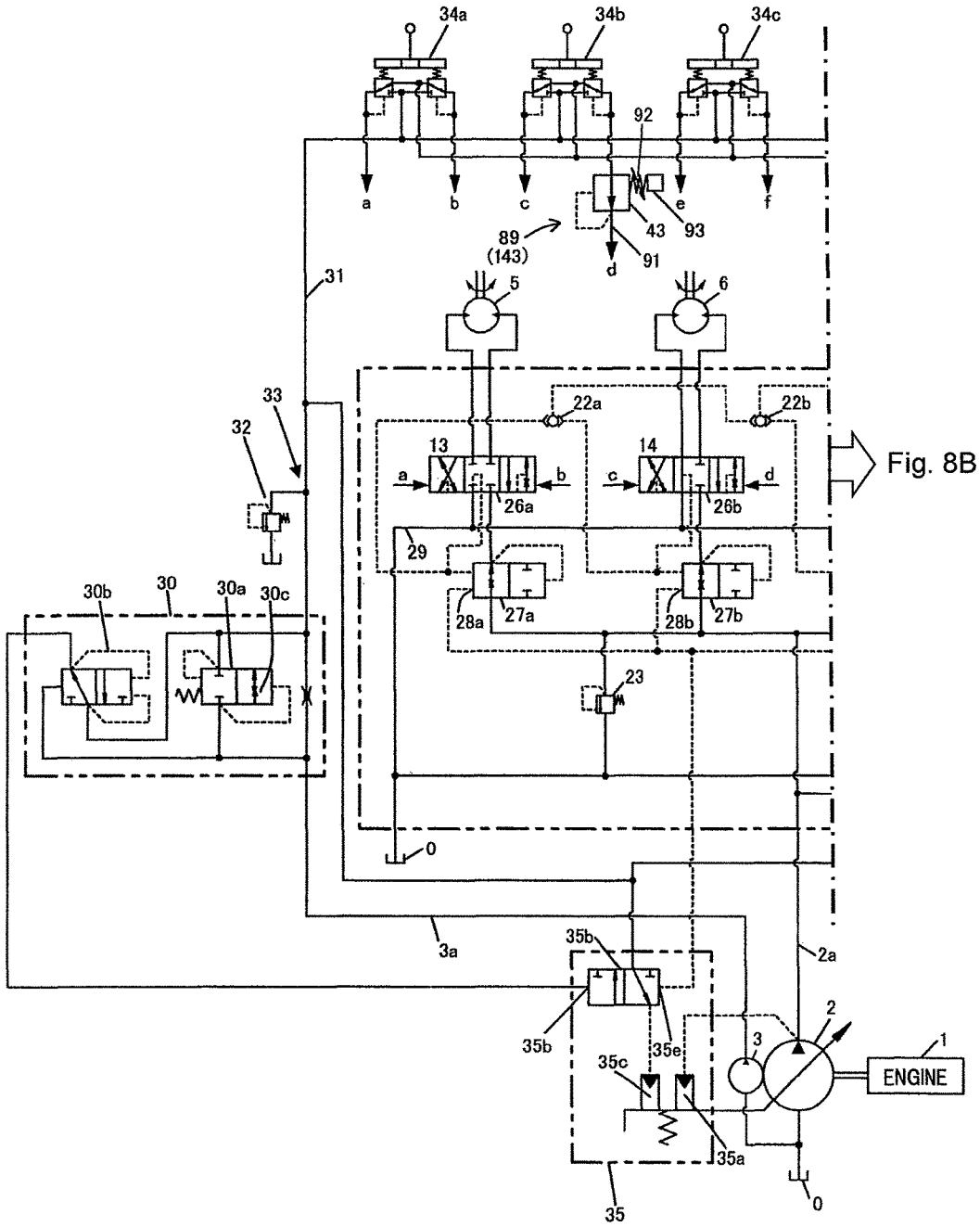
FIG. 8A is a diagram showing a left-hand half of a hydraulic drive system according to a sixth embodiment of the present invention.
Figures 8A, 8B:
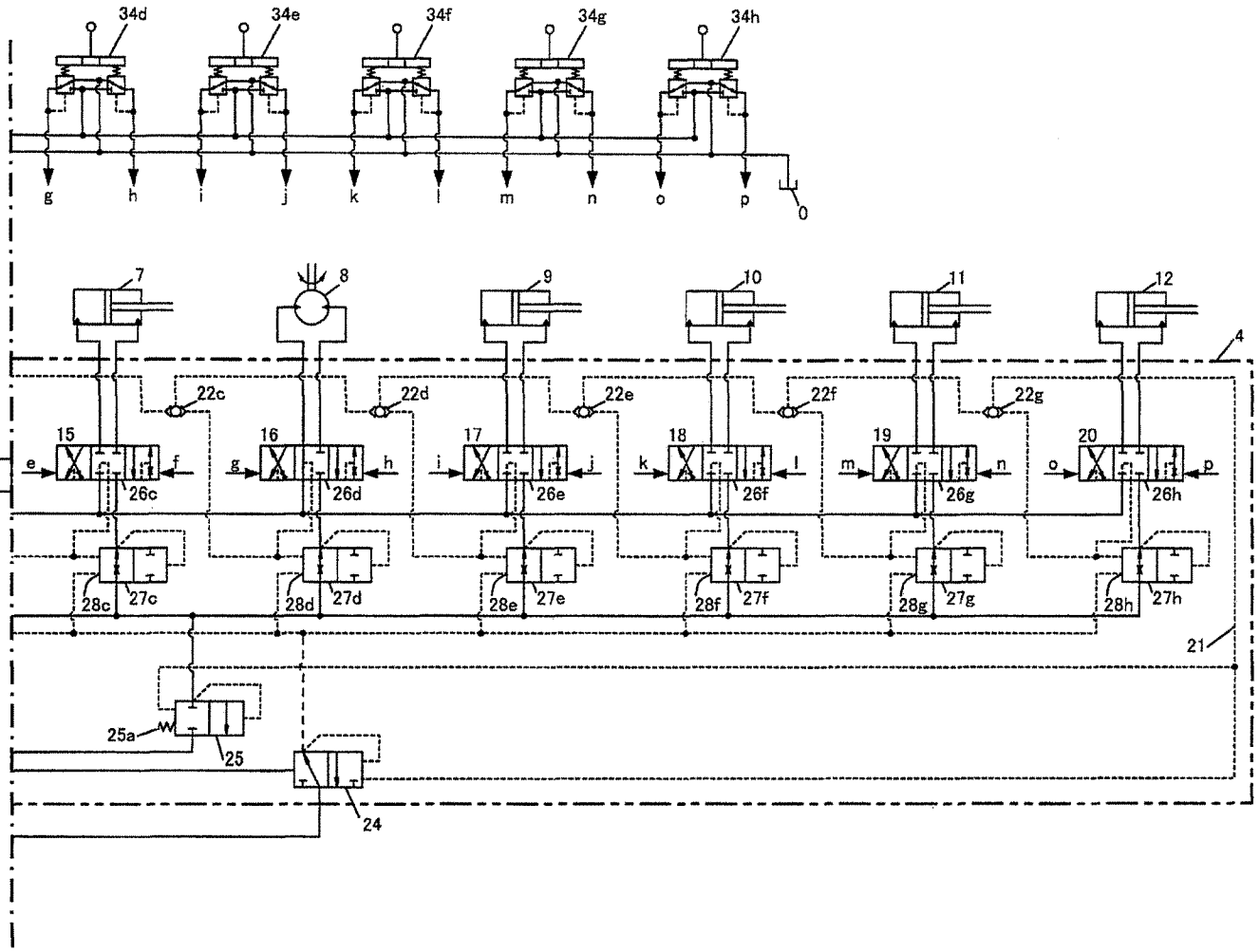
FIG. 8B is a diagram showing a right-hand half of the hydraulic drive system according to the sixth embodiment of the present invention.

FIGS. 8A and 8B show a hydraulic drive system for a working machine according to a sixth embodiment of the present invention.

In the fifth embodiment, the flow rate correction device 79 is configured with the pressure control valve unit 142 that is disposed between the remote control valve of the control lever device 34*b* (or 34*d*) for track and the flow control valve 26*b* (or 26*d*) and includes the pressure control valve 42 for reducing the control pilot pressure of the remote control valve. In this embodiment, in contrast, a flow rate correction device 89 is configured with a pressure reducing valve unit 143 that is disposed between a remote control valve of a control lever device 34*b* (or 34*d*) for track and a flow control valve 26*b* (or 26*d*) and includes a pressure reducing valve 43 that reduces a control pilot pressure of the remote control valve. The pressure reducing valve 43 includes an adjusting device (an adjusting mechanism 93) for adjusting a maximum flow rate of the flow control valve 26*b* for the left track (or the flow control valve 26*d* for the right track).

Specifically, the hydraulic drive system shown in FIGS. 8A and 8B applies to a condition in which, when control levers of the control lever devices 34*b*, 34*d* for tracks are operated all the way in the right direction shown in the figures with an intention of traveling in a straight-ahead direction, a left track motor 6 runs at a speed higher than a right track motor 8. The hydraulic drive system includes the pressure reducing valve unit 143 connected to a line that introduces, of control pilot pressures c, d generated by the remote control valve of the control lever device 34*b* for the left track, the control pilot pressure d for a forward travel to the flow control valve 26*b*. The pressure reducing valve unit 143 includes the pressure reducing valve 43 that reduces the control pilot pressure d for a forward travel. The pressure control valve unit 143 includes a line 91 in which the pressure reducing valve 43 is disposed. The line 91 has an upstream side connected to the remote control valve of the control lever device 34*b* for the left track that outputs the control pilot pressure d for a forward travel and a downstream side connected to a line that introduces the control pilot pressure d for a forward travel to the flow control valve 26*b*. The pressure reducing valve 43 includes, as the adjusting device for adjusting the maximum flow rate of the flow control valve 26*b*, the adjusting mechanism 93 that adjusts a biasing force of a spring 92 for setting a pressure reducing valve output pressure.

Similarly to the adjusting mechanism-mounted plug 37 shown in FIG. 2B, the adjusting mechanism 93 includes an adjusting pin and a lock nut, not shown and built into the pressure reducing valve 43. The pressure reducing valve 43 reduces a maximum pressure of the control pilot pressure d for a forward travel generated by the remote control valve of the control lever device 34*b* for the left track to a pressure corresponding to the setting of the spring 92. A stroke of the flow control valve 26*b* is thereby restricted for a controlled flow rate.

Other arrangements are the same as those of the first embodiment.

Functions of the sixth embodiment will be described below.

When the control levers of the control lever devices 34*b*, 34*d* for tracks are operated all the way in the right direction shown in the figures with an intention of traveling in a straight-ahead direction, control pilot pressures d, h for operating the flow control valves 26*b*, 26*d* are generated from the hydraulic fluid of a pilot hydraulic fluid source 33 and introduced to the flow control valves 26*b*, 26*d*. The hydraulic fluid delivered from a main pump 2 is introduced to the left and right track motors 6, 8 via pressure compensating valves 27*b*, 27*d* and the flow control valves 26*b*, 26*d*.

Actuator load pressures of the left and right track motors 6, 8 introduced to valve opening-side pressure receiving portions 28*b*, 28*d* of the pressure compensating valves 27*b*, 27*d* for the left and right tracks are, by their nature, equal to each other at this time. In rare cases, however, machine weight balance or manufacturing errors involved in the track motors may result in different actuator load pressures, so that a difference in speed (difference in revolutions per minute) occurs between the left and right track motors 6, 8, causing skew to occur.

A traveling test upon shipment from the factory is conducted through the operation described above. If skew occurs, the pressure reducing valve unit 143 is connected to the line that introduces the control pilot pressure d (or h) for operating the flow rate control valve whichever is higher in speed to the flow control valve 26*b* (or 26*d*). The adjusting pin of the adjusting mechanism 93 of the pressure reducing valve 43 is then operated in order to weaken the biasing force of the spring 92. The control pilot pressure d (or h) is thereby reduced and the stroke of the flow control valve 26*b* (or 26*d*) is thus restricted, so that the output flow rate of the flow control valve 26*b* (or 26*d*) is adjusted. This allows skew traveling to be corrected for straight line traveling.

As described heretofore, the same effects as in the first embodiment can be achieved also in this embodiment.

Seventh Embodiment

Figure 9:
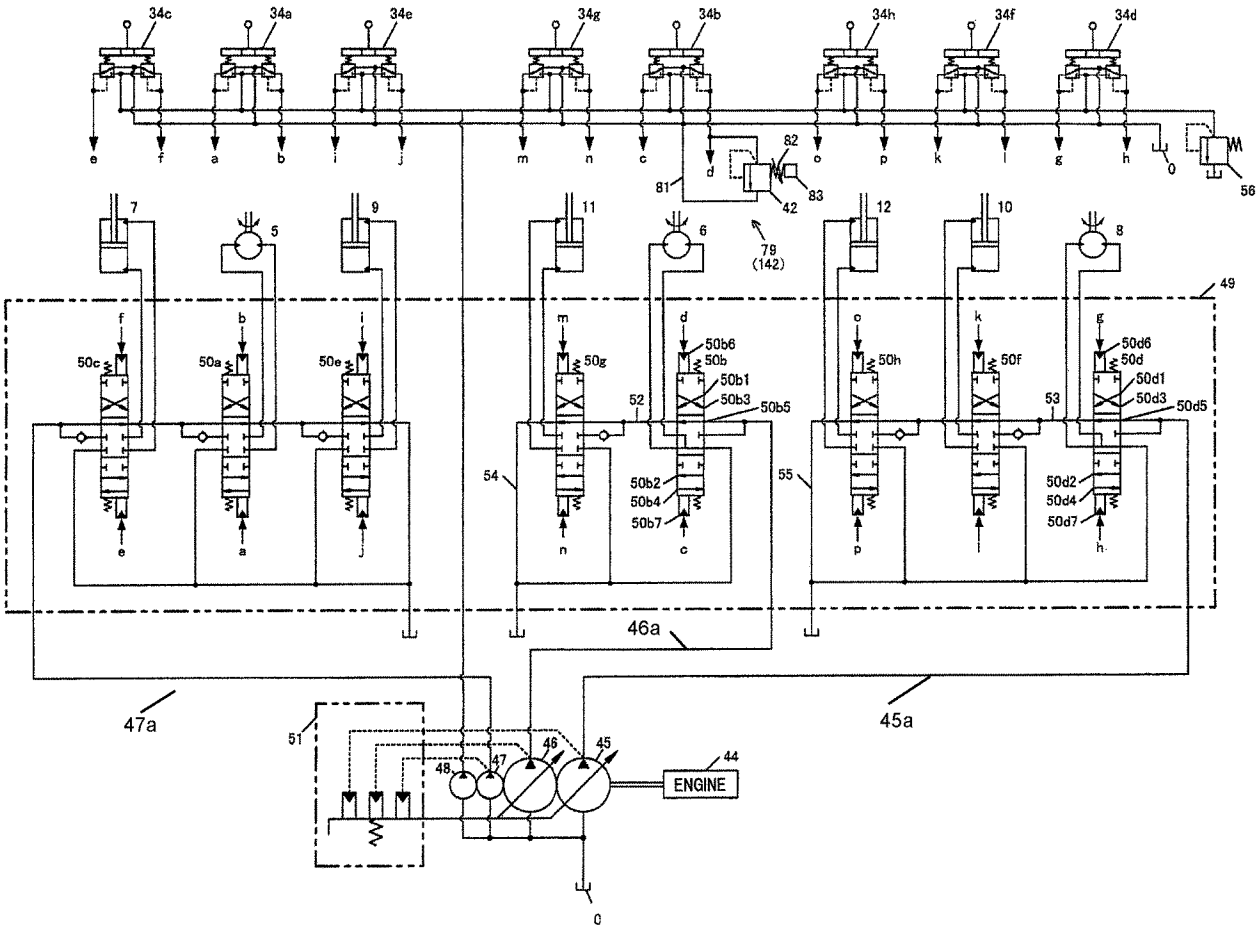
FIG. 9 is a diagram showing a hydraulic drive system according to a seventh embodiment of the present invention.

FIG. 9 shows a hydraulic drive system for a working machine according to a seventh embodiment of the present invention.

Referring to FIG. 9, the hydraulic drive system of this embodiment includes an engine 44, three main pumps 45, 46, 47, a pilot pump 48, a plurality of actuators 5, 6, 7, 8, 9, 10, 11, 12, and a control valve 49. Specifically, the main pumps 45, 46, 47 are driven by the engine 44. The pilot pump 48 is operatively associated with the main pumps 45, 46, 47 and driven by the engine 44. The actuators 5, 6, 7, 8, 9, 10, 11, 12 are driven by hydraulic fluid delivered from the main pumps 45, 46, 47.

The working machine including a track device of crawler type according to this embodiment is, for example, a hydraulic mini-excavator. The actuator 5 is, for example, a swing motor of the hydraulic excavator, the actuators 6, 8 are left and right track motors of the hydraulic excavator, the actuator 7 is a blade cylinder of the hydraulic excavator, the actuator 9 is a swing cylinder of the hydraulic excavator, and the actuators 10, 11, 12 are a boom cylinder, an arm cylinder, and a bucket cylinder, respectively, of the hydraulic excavator.

The control valve 49 includes a plurality of flow control valves that are connected to hydraulic fluid supply lines 45*a*, 46*a*, 47*a* of the main pumps 45, 46, 47 and control directions and flow rates of the hydraulic fluid supplied from the main pumps 45, 46, 47 to respective actuators.

Flow control valves 50*a* to 50*h* control directions and flow rates of the hydraulic fluid supplied from the main pumps 45, 46, 47 to the respective actuators 5 to 12.

When the flow control valves 50*b*, 50*d* are operated to change their positions, the hydraulic fluid delivered from delivery ports of the two hydraulic pumps 45, 46 is introduced to the respective track motors 6, 8 via a meter-in flow path (incoming flow path) 50*b*1 or 50*b*2; 50*d*1 or 50*d*2 of the flow control valves 50*b*, 50*d*. Return fluid from the track motors 6, 8 is returned to a tank 0 via a meter-out flow path (outgoing flow path) 50*b*3 or 50*b*4, 50*d*3 or 50*d*4 of the flow control valves 50*b*, 50*d*.

The hydraulic pumps 45, 46 are a variable displacement type. By controlling a tilting position, a volume (displacement volume) is varied to thereby increase or decrease the delivery flow rate. Typically, a horsepower control actuator 51 is provided as means for controlling the hydraulic pumps 45, 46. The tilting position is controlled such that, when the delivery pressure of the hydraulic pumps 45, 46 increases, the flow rate is reduced accordingly.

The flow control valves 50*b*, 50*d* are an open center type (center bypass type) and include center bypass flow paths 50*b*5, 50*d*5 that connect to center bypass lines 52, 53. When the flow control valves 50*b*, 50*d* are at their neutral positions (not operated positions), the center bypass flow paths 50*b*5, 50*d*5 are fully open and the meter-in flow paths 50*b*1, 50*b*2; 50*d*1, 50*d*2 are fully closed, so that the delivery fluid from the hydraulic pumps 45, 46 is returned to the tank via tank lines 54, 55 through the hydraulic fluid supply lines 45*a*, 46*a* connected to delivery ports of the hydraulic pumps 45, 46, the center bypass lines 52, 53, and the center bypass flow paths 50*b*5, 50*d*5. When the flow control valves 50*b*, 50*d* are operated from their neutral positions to operated positions, the center bypass flow paths 50*b*5, 50*d*5 decrease their opening areas according to operation amounts of the flow control valves 50*b*, 50*d* and are fully closed immediately before maximum changeover positions (full stroke positions) of the flow control valves 50*b*, 50*d*. Meanwhile, the meter-in flow paths 50*b*1, 50*b*2; 50*d*1, 50*d*2 of the flow control valves 50*b*, 50*d* increase their opening areas according to the operation amounts of the flow control valves 50*b*, 50*d* and are fully open immediately before the maximum changeover positions (full stroke positions) of the flow control valves 50*b*, 50*d*. This results in the flow rate varying according to the operation amounts of the flow control valves 50*b*, 50*d* being supplied to the track motors 6, 8, so that the speed of the track motors 6, 8 is controlled. A main relief valve (not shown) that serves as safety means for restricting the maximum delivery pressure of the hydraulic pumps 45, 46 is disposed in the hydraulic fluid supply lines 45*a*, 46*a*.

The flow control valves 50*b*, 50*d* are hydraulic changeover valves including hydraulic pilot portions 50*b*6, 50*b*7 and 50*d*6, 50*d*7. The flow control valves 50*b*, 50*d* are operated by a control pilot pressure generated by remote control valves of control lever devices 34*b*, 34*d* for tracks. A delivery pressure of the pilot pump 48 is introduced as a primary pressure to the remote control valves of the control lever devices 34*b*, 34*d* for tracks. The hydraulic pumps 45, 46 and the pilot pump 48 are driven by the engine 44. The delivery pressure of the pilot pump 48 is maintained at a predetermined value by a pilot relief valve 56.

With control levers of the control lever devices 34*b*, 34*d* for tracks placed in the neutral position, the hydraulic pilot portions 50*b*6, 50*b*7 and 50*d*6, 50*d*7 of the flow control valves 50*b*, 50*d* communicate with the tank 0 via the remote control valves of the control lever devices 34*b*, 34*d* for tracks. When the control levers of the control lever devices 34*b*, 34*d* for tracks are operated, the corresponding remote control valve of the control lever devices 34*b*, 34*d* for tracks is pressurized and the resultant pressure (output pressure) is introduced as the control pilot pressure to the corresponding hydraulic pilot portions 50*b*6, 50*b*7 and 50*d*6, 50*d*7 of the flow control valves 50*b*, 50*d*. This changes the position of the flow control valves 50*b*, 50*d*, so that the hydraulic fluid is supplied to the track motors 6, 8 to rotate the track motors 6, 8.

The hydraulic drive device of this embodiment includes the same flow rate correction device 79 (pressure control valve unit 142) as that incorporated in the hydraulic drive device of the fifth embodiment.

Specifically, the hydraulic drive system shown in FIG. 9 applies to a condition in which, when the control levers of the control lever devices 34*b*, 34*d* for tracks are operated all the way in the right direction shown in the figure with an intention of traveling in a straight-ahead direction, the left track motor 6 runs at a speed higher than the right track motor 8. The hydraulic drive system includes the pressure control valve unit 142 connected to a line that introduces, of control pilot pressures c, d generated by the remote control valve of the control lever device 34*b* for the left track, the control pilot pressure d for a forward travel to the flow control valve 26*b*. The pressure control valve unit 142 includes a pressure control valve 42 that reduces the control pilot pressure d for a forward travel. The pressure control valve unit 142 includes a line 81 in which the pressure control valve 42 is disposed. The line 81 has an upstream side connected to the remote control valve of the control lever device 34*b* for the left track that outputs the control pilot pressure d for a forward travel and a downstream side connected to a tank line. The pressure control valve 42 is a variable relief valve that includes, as an adjusting device for adjusting the maximum flow rate of the flow control valve 50*b*, an adjusting mechanism 83 that adjusts a biasing force of a spring 82 for setting a relief pressure.

Similarly to the adjusting mechanism-mounted plug 37 shown in FIG. 2B, the adjusting mechanism 83 includes an adjusting pin and a lock nut, not shown and built into the pressure control valve 42. The pressure control valve 42 limits a maximum pressure of the control pilot pressure d for a forward travel generated by the remote control valve of the control lever device 34*b* for the left track to a pressure corresponding to the setting of the spring 82. A stroke of the flow control valve 50*b* is thereby restricted for a controlled flow rate.

Functions of the seventh embodiment will be described below.

When the control levers of the control lever devices 34*b*, 34*d* for tracks are operated all the way in the right direction shown in the figure with an intention of traveling in a straight-ahead direction, the control pilot pressures d, h for operating the flow control valves 50*b*, 50*d* are generated from the hydraulic fluid of the pilot pump 48 and introduced to the flow control valves 50*b*, 50*d*. The hydraulic fluid delivered from the main pumps 45, 46 is introduced to the left and right track motors 6, 8 via the flow control valves 50*b*, 50*d*.

Flow rates introduced to the left and right track motors 6, 8 are, by their nature, equal to each other at this time. In rare cases, however, manufacturing errors involved in the main pumps 45, 46 and the track motors may result in different flow rates, so that a difference in speed (difference in revolutions per minute) occurs between the left and right track motors 6, 8, causing skew to occur.

A traveling test upon shipment from the factory is conducted through the operation described above. If skew occurs, the pressure control valve unit 142 is connected across the line that introduces the control pilot pressure d (or h) for operating the flow rate control valve whichever is higher in speed to the flow control valve 50*b* (or 50*d*) and the tank line. The adjusting pin of the adjusting mechanism 83 of the pressure control valve 42 is then operated in order to weaken the biasing force of the spring 82. The control pilot pressure d (or h) is thereby reduced and the stroke of the flow control valve 50*b* (or 50*d*) is thus restricted, so that the output flow rate of the flow control valve 50*b* (or 50*d*) is adjusted. This allows skew traveling to be corrected for straight line traveling.

As described heretofore, the same effects as in the first embodiment can be achieved also in this embodiment.

Eighth Embodiment

Figure 10:
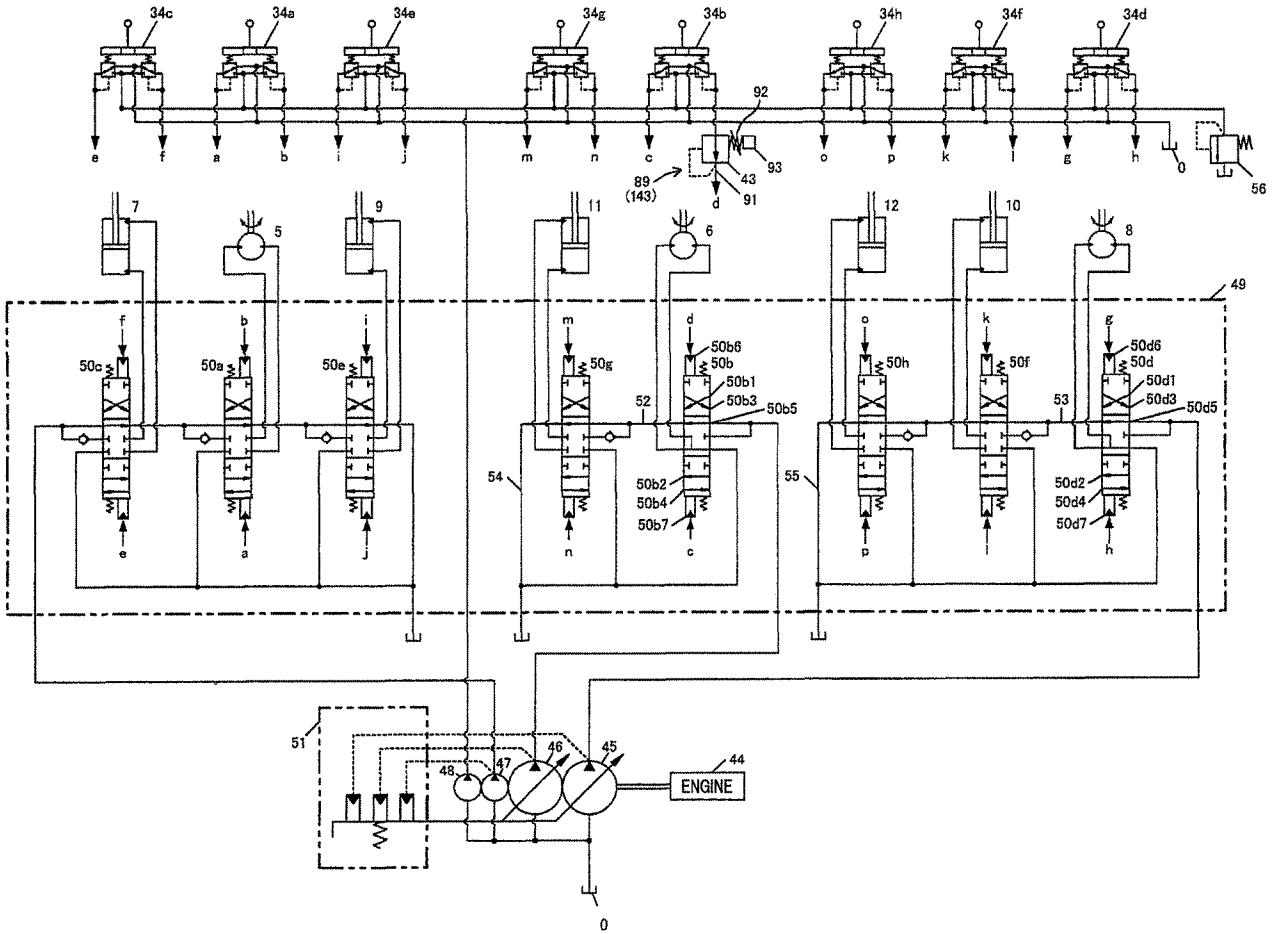
FIG. 10 is a diagram showing a hydraulic drive system according to an eighth embodiment of the present invention.

FIG. 10 shows a hydraulic drive system for a working machine according to an eighth embodiment of the present invention.

The hydraulic drive system of this embodiment includes the same flow rate correction device 89 (pressure reducing valve unit 143) as that incorporated in the hydraulic drive system of the sixth embodiment.

Specifically, the hydraulic drive system shown in FIG. 10 applies to a condition in which, when control levers of control lever devices 34*b*, 34*d* for tracks are operated all the way in the right direction shown in the figure with an intention of traveling in a straight-ahead direction, a left track motor 6 runs at a speed higher than a right track motor 8. The hydraulic drive system includes the pressure reducing valve unit 143 connected to a line that introduces, of control pilot pressures c, d generated by a remote control valve of the control lever device 34*b* for the left track, the control pilot pressure d for a forward travel to a flow control valve 50*b*. The pressure reducing valve unit 143 includes a pressure reducing valve 43 that reduces the control pilot pressure d for a forward travel. The pressure control valve unit 143 includes a line 91 in which the pressure reducing valve 43 is disposed. The line 91 has an upstream side connected to the remote control valve of the control lever device 34*b* for the left track that outputs the control pilot pressure d for a forward travel and a downstream side connected to a line that introduces the control pilot pressure d for a forward travel to the flow control valve 50*b*. The pressure reducing valve 43 includes, as an adjusting device for adjusting the maximum flow rate of the flow control valve 50*b* for the left track, an adjusting mechanism 93 that adjusts a biasing force of a spring 92 for setting a pressure reducing valve output pressure.

Similarly to the adjusting mechanism-mounted plug 37 shown in FIG. 2B, the adjusting mechanism 93 includes an adjusting pin and a lock nut, not shown and built into the pressure reducing valve 43. The pressure reducing valve 43 reduces a maximum pressure of the control pilot pressure d for a forward travel generated by the remote control valve of the control lever device 34*b* for the left track to a pressure corresponding to the setting of the spring 92. A stroke of the flow control valve 50*b* is thereby restricted for a controlled flow rate.

Other arrangements are the same as those of the seventh embodiment.

Functions of the eighth embodiment will be described below.

When the control levers of the control lever devices 34*b*, 34*d* for tracks are operated all the way in the right direction shown in the figure with an intention of traveling in a straight-ahead direction, the control pilot pressures d, h for operating the flow control valves 50*b*, 50*d* are generated from the hydraulic fluid of a pilot pump 48 and introduced to the flow control valves 50*b*, 50*d*. The hydraulic fluid delivered from main pumps 45, 46 is introduced to the left and right track motors 6, 8 via the flow control valves 50*b*, 50*d*.

Flow rates introduced to the left and right track motors 6, 8 are, by their nature, equal to each other at this time. In rare cases, however, manufacturing errors involved in the main pumps 45, 46 and the track motors may result in different flow rates, so that a difference in speed (difference in revolutions per minute) occurs between the left and right track motors 6, 8, causing skew to occur.

A traveling test upon shipment from the factory is conducted through the operation described above. If skew occurs, the pressure reducing valve unit 143 is connected to the line that introduces the control pilot pressure d (or h) for operating the flow rate control valve whichever is higher in speed to the flow control valve 50*b* (or 50*d*). The adjusting pin of the adjusting mechanism 93 of the pressure reducing valve 43 is then operated in order to weaken the biasing force of the spring 92. The control pilot pressure d (or h) is thereby reduced and the stroke of the flow control valve 50*b* (or 50*d*) is thus restricted, so that the output flow rate of the flow control valve 50*b* (or 50*d*) is adjusted. This allows skew traveling to be corrected for straight line traveling.

As described heretofore, the same effects as in the first embodiment can be achieved also in this embodiment.

<Miscellaneous>

Although the present invention has been described with respect to specific embodiments in which the present invention is applied to the hydraulic excavator, the invention is not to be duly limited to those illustrative embodiments set forth herein. For example, the fifth to eighth embodiments have been described for cases in which the flow rate correction device is mounted for making adjustments when a skew traveling fault is found during the pre-shipment inspection of the working machine. The flow rate correction device may nonetheless be mounted in advance on the hydraulic drive system of the working machine, as in the second and fourth embodiments, and the adjustments may be made after the skew traveling fault is thereafter found.

The foregoing embodiments have been described for cases in which the working machine is a hydraulic excavator. The similar effects can still be achieved by applying the present invention to any type of working machines (e.g. a hydraulic crane and a bulldozer) other than the hydraulic excavator as long as the working machine includes a track device of crawler type.

DESCRIPTION OF REFERENCE NUMERALS

1: Engine
2: Main pump
3: Pilot pump
4: Control valve
5, 6, 7, 8, 9, 10, 11, 12: Actuator
(6, 8: Left and right track motors)
13, 14, 15, 16, 17, 18, 19, 20: Valve section
25: Unloading valve
26*a* to 26*h*: Flow control valve
27*a* to 27*h*: Pressure compensating valve
28*a* to 28*h*: Pressure receiving portion
30: Engine speed detecting valve device
34*a* to 34*h*: Control lever device
34*b*: Control lever device (track operating device)
34*d*: Control lever device (track operating device)
35: Pump control unit
36*b*, 36*d*: Target compensating differential pressure adjusting spring
37: Adjusting mechanism-mounted plug
37A, 37B: Adjusting mechanism-mounted plug
37*a*: Plug main unit
37*b*: Adjusting pin
37*c*: Lock nut
38: Housing
39: Flow rate correction device (target compensating differential pressure adjusting device)
39A, 39B: Flow rate correction device (target compensating differential pressure adjusting device)
40: Pressure reducing valve
40*b*, 40*d*: Pressure reducing valve
42: Pressure control valve
43: Pressure reducing valve
44: Engine
45, 46, 47: Main pump
49: Control valve
50*a* to 50*h*: Flow control valve
61*b*, 61*d*: Valve element
65*b*, 65*d*: Plug
66*b*, 66*d*: Correction pressure receiving portion
69: Flow rate correction device (target compensating differential pressure adjusting device)
69A, 69B: Flow rate correction device (target compensating differential pressure adjusting device)
71: Line
71*b*, 71*d*: Line
72: Spring
72*b*, 72*d*: Spring
73: Adjusting mechanism-mounted plug
73*b*, 73*d*: Adjusting mechanism-mounted plug
79: Flow rate correction device
81: Line
82: Spring
83: Adjusting mechanism-mounted plug
89: Flow rate correction device
91: Line
92: Spring
93: Adjusting mechanism-mounted plug
140: Pressure reducing valve unit
140A, 140B: Pressure reducing valve unit
142: Pressure control valve unit
143: Pressure reducing valve unit

What is claimed is:

1. A hydraulic drive system for a working machine including a track device of crawler type, comprising:

a variable displacement type main pump;

a plurality of actuators including first and second track hydraulic motors driven by a hydraulic fluid delivered from the main pump;

a plurality of flow control valves, including first and second track flow control valves, to control a plurality of flow rates of the hydraulic fluid supplied from the main pump to the plurality of actuators;

a plurality of control devices including first and second track control devices that each generates a control pilot pressure for operating the plurality of flow control valves using a hydraulic pressure of a pilot hydraulic fluid source as a source pressure;

left and right crawlers driven through rotation of the first and second track hydraulic motors, respectively;

a differential pressure reducing valve that outputs a differential pressure between a delivery pressure of the main pump and a maximum load pressure of the actuators;

a plurality of pressure compensating valves, including first and second track pressure compensating valves, each of the plurality of pressure compensating valves having a valve opening-side pressure receiving portion to which an output pressure of the differential pressure reducing valve is introduced and a spring that applies a biasing force in a valve opening direction, and which each controls a respective differential pressure across each of the flow control valves such that the differential pressure across each of the flow control valves equals a target compensating differential pressure that is set based on the output pressure of the differential pressure reducing valve;

a pump control unit for performing load sensing control of a displacement volume of the main pump such that the delivery pressure of the main pump is higher, by a target differential pressure, than the maximum load pressure of the actuators;

an adjusting mechanism-mounted plug that is adapted to increase a maximum flow rate output from a lower speed side track flow control valve which is one of the first and the second track flow control valve and which corresponds to a lower speed side of the one of first and the second track hydraulic motors such that a difference in speed between the first and the second track hydraulic motors will not occur when control levers of the ones of the first and second track control devices are operated all the way; and wherein the adjusting mechanism-mounted plug has an adjusting pin for strengthening the biasing force of the spring by varying a position of the adjusting plug in an axial direction, thereby increasing the target compensating differential pressure of the lower speed side track flow control valve, and has a lock nut for fixing the position of the adjusting pin in the axial direction, and wherein the adjusting mechanism mounted plug is disposed on the lower speed side track flow control valve such that a differential pressure across the lower speed side track flow control valve, which is the one of the first and the second track flow control valve corresponding to a lower speed side of the one of the first or the second track hydraulic motor equals the target compensating differential pressure that is set based on the output pressure of the differential pressure reducing valve.

* * * * *